US009294862B2

(12) United States Patent
Kim et al.

(10) Patent No.: US 9,294,862 B2
(45) Date of Patent: Mar. 22, 2016

(54) METHOD AND APPARATUS FOR PROCESSING AUDIO SIGNALS USING MOTION OF A SOUND SOURCE, REVERBERATION PROPERTY, OR SEMANTIC OBJECT

(75) Inventors: Hyun-Wook Kim, Suwon-si (KR); Chul-Woo Lee, Anyang-si (KR); Jong-Hoon Jeong, Suwon-si (KR); Nam-Suk Lee, Suwon-si (KR); Han-Gil Moon, Seoul (KR); Sang-Hoon Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 879 days.

(21) Appl. No.: 12/988,430

(22) PCT Filed: Apr. 16, 2009

(86) PCT No.: PCT/KR2009/001988

§ 371 (c)(1),
(2), (4) Date: Oct. 18, 2010

(87) PCT Pub. No.: WO2009/128666

PCT Pub. Date: Oct. 22, 2009

(65) Prior Publication Data

US 2011/0060599 A1 Mar. 10, 2011

Related U.S. Application Data

(60) Provisional application No. 61/071,213, filed on Apr. 17, 2008.

(30) Foreign Application Priority Data

Apr. 15, 2009 (KR) ..... 10-2009-0032756

(51) Int. Cl.
*G10L 19/00* (2013.01)
*G10L 21/00* (2013.01)
(Continued)

(52) U.S. Cl.
CPC . *H04S 7/30* (2013.01); *G10L 19/00* (2013.01); *H04R 5/04* (2013.01); *H04S 2400/03* (2013.01); *H04S 2400/11* (2013.01)

(58) Field of Classification Search
CPC ... G10L 19/00; G10L 19/0017; G10L 19/008; G10L 19/16; G10L 19/167; G10L 2019/00
USPC ..... 704/201, 500, 503
See application file for complete search history.

(56) References Cited

U.S. PATENT DOCUMENTS 4,972,484 A 11/1990 Theile et al.
5,109,352 A 4/1992 O'Dell
(Continued)

FOREIGN PATENT DOCUMENTS

EP 1162844 A2 12/2001
JP 6-46499 A 2/1994
(Continued)

OTHER PUBLICATIONS

Dow, Robert J. "Multi-Channel Sound in Spatially Rich Acousmatic Composition" University of Edinburg, 2004.*
(Continued)

*Primary Examiner* — Paras D Shah
(74) *Attorney, Agent, or Firm* — Sughrue Mion, PLLC

(57) ABSTRACT

Methods and apparatuses for encoding and decoding an audio signal are provided, a method of encoding an audio signal including: receiving the audio signal including information about a moving sound source; receiving position information about the moving sound source; generating dynamic track information indicating motion of the moving sound source by using the position information; and encoding the audio signal and the dynamic track information.

101 Claims, 15 Drawing Sheets

(51) Int. Cl.
*H04S 7/00* (2006.01)
*H04R 5/04* (2006.01)

(56) References Cited

U.S. PATENT DOCUMENTS

| | | | | |
|---|---|---|---|---|
| 5,162,923 | A | 11/1992 | Yoshida et al. | |
| 5,581,653 | A | 12/1996 | Todd | |
| 5,673,289 | A | 9/1997 | Kim et al. | |
| 5,956,674 | A | 9/1999 | Smyth et al. | |
| 6,098,041 | A | 8/2000 | Matsumoto | |
| 6,300,888 | B1 | 10/2001 | Chen et al. | |
| 6,456,963 | B1 | 9/2002 | Araki | |
| 6,570,991 | B1 | 5/2003 | Scheirer et al. | |
| 6,748,362 | B1 * | 6/2004 | Meyer et al. | 704/500 |
| 7,015,978 | B2 | 3/2006 | Jeffers et al. | |
| 7,179,980 | B2 | 2/2007 | Kirkeby et al. | |
| 7,185,049 | B1 | 2/2007 | Benitez et al. | |
| 7,197,454 | B2 | 3/2007 | Van Der Kerkhof | |
| 7,489,788 | B2 * | 2/2009 | Leung et al. | 381/92 |
| 7,562,021 | B2 | 7/2009 | Mehrotra et al. | |
| 7,613,603 | B2 | 11/2009 | Yamashita | |
| 7,630,882 | B2 | 12/2009 | Mehrotra et al. | |
| 7,634,073 | B2 * | 12/2009 | Kanada | 379/202.01 |
| 7,873,510 | B2 | 1/2011 | Kurniawati et al. | |
| 8,010,348 | B2 | 8/2011 | Son et al. | |
| 8,078,978 | B2 | 12/2011 | Perry et al. | |
| 8,407,059 | B2 * | 3/2013 | Cho | 704/500 |
| 2001/0024504 | A1 * | 9/2001 | Jot et al. | 381/63 |
| 2002/0066101 | A1 | 5/2002 | Gordon et al. | |
| 2004/0030556 | A1 | 2/2004 | Bennett et al. | |
| 2004/0057586 | A1 | 3/2004 | Licht | |
| 2004/0183703 | A1 | 9/2004 | Kim et al. | |
| 2004/0243419 | A1 | 12/2004 | Wang | |
| 2005/0126369 | A1 | 6/2005 | Kirkeby et al. | |
| 2005/0257134 | A1 | 11/2005 | Goodman et al. | |
| 2006/0163337 | A1 | 7/2006 | Unruh | |
| 2006/0265648 | A1 | 11/2006 | Rainisto et al. | |
| 2006/0268982 | A1 | 11/2006 | Lee et al. | |
| 2007/0014353 | A1 | 1/2007 | Yourlo | |
| 2007/0016412 | A1 | 1/2007 | Mehrotra et al. | |
| 2007/0016414 | A1 | 1/2007 | Mehrotra et al. | |
| 2007/0086664 | A1 | 4/2007 | Kim et al. | |
| 2007/0140499 | A1 | 6/2007 | Davis | |
| 2007/0174274 | A1 | 7/2007 | Kim et al. | |
| 2007/0255562 | A1 | 11/2007 | Kurniawati et al. | |
| 2007/0269063 | A1 * | 11/2007 | Goodwin et al. | 381/310 |
| 2008/0010062 | A1 | 1/2008 | Son et al. | |
| 2008/0072143 | A1 | 3/2008 | Assadollahi | |
| 2008/0181432 | A1 * | 7/2008 | Jeong et al. | 381/94.1 |
| 2008/0182599 | A1 | 7/2008 | Rainisto et al. | |
| 2008/0195924 | A1 | 8/2008 | Kim et al. | |
| 2008/0212795 | A1 | 9/2008 | Goodwin et al. | |
| 2008/0281583 | A1 | 11/2008 | Slothouber et al. | |
| 2008/0281602 | A1 * | 11/2008 | Van Schijndel et al. | 704/500 |
| 2009/0006103 | A1 | 1/2009 | Koishida et al. | |
| 2009/0031240 | A1 | 1/2009 | Hildreth | |
| 2009/0043591 | A1 * | 2/2009 | Breebaart et al. | 704/500 |
| 2009/0079813 | A1 | 3/2009 | Hildreth | |
| 2009/0092259 | A1 * | 4/2009 | Jot et al. | 381/17 |
| 2009/0116652 | A1 * | 5/2009 | Kirkeby et al. | 381/1 |
| 2009/0198691 | A1 | 8/2009 | Kraft et al. | |
| 2009/0292544 | A1 * | 11/2009 | Virette et al. | 704/501 |
| 2010/0010977 | A1 | 1/2010 | Choi et al. | |
| 2010/0017204 | A1 | 1/2010 | Oshikiri et al. | |
| 2010/0121876 | A1 | 5/2010 | Simpson et al. | |
| 2010/0274558 | A1 | 10/2010 | Yamanashi et al. | |
| 2011/0004513 | A1 | 1/2011 | Hoffberg | |
| 2011/0035227 | A1 | 2/2011 | Lee et al. | |
| 2011/0087961 | A1 | 4/2011 | Fitusi et al. | |
| 2012/0029910 | A1 | 2/2012 | Medlock | |
| 2012/0078615 | A1 | 3/2012 | Sengupta | |
| 2012/0191716 | A1 | 7/2012 | Omoigui | |
| 2014/0095178 | A1 | 4/2014 | Beack et al. | |

FOREIGN PATENT DOCUMENTS

| | | | |
|---|---|---|---|
| KR | 10-2000-0037593 | A | 7/2000 |
| KR | 10-2004-0103443 | A | 12/2004 |
| KR | 10-2006-0000780 | A | 1/2006 |
| KR | 10-0589446 | B1 | 6/2006 |
| KR | 1020070034481 | A | 3/2007 |
| KR | 10-0786022 | B1 | 12/2007 |
| KR | 1020080025403 | A | 3/2008 |
| KR | 1020080029940 | A | 4/2008 |
| WO | 89/08364 | A1 | 9/1989 |
| WO | WO 2007004833 | A2 * | 1/2007 |

OTHER PUBLICATIONS

International Search Report for PCT/KR2009/001988 issued Dec. 17, 2009 [PCT/ISA/210].
Written Opinion for PCT/KR2009/01988 issued Dec. 17, 2009 [PCT/ISA/237].
Communication (PCT/ISA/210 and PCT/ISA/220) dated Dec. 1, 2009 issued by the International Searching Authority in counterpart International Application No. PCT/KR2009/001954.
Communication (PCT/ISA/237) dated Dec. 1, 2009 issued by the International Searching Authority in counterpart International Application No. PCT/KR2009/001954.
Communication dated Oct. 19, 2010 issued by the International Searching Authority in counterpart International Application No. PCT/KR2009/001989.
Non-Final Office Action, dated Dec. 28, 2012, issued by the U.S. Patent and Trademark Office in related U.S. Appl. No. 12/988,426.
Final Office Action, dated Mar. 7, 2013, issued by the U.S. Patent and Trademark Office in related U.S. Appl. No. 12/988,382.
Non-Final Office Action, dated Sep. 4, 2012, issued by the U.S. Patent and Trademark Office in related U.S. Appl. No. 12/988,382.
Tucker, Roger C.F., "Low Bit-Rate Frequency Extension Coding," IEEE Colloquium on Audio and Music Technology, Nov. 1998, 5 pages.
Communication dated Feb. 16, 2015 issued by the Korean Intellectual Property Office in counterpart Application No. 10-2009-0032757.
Communication dated Jun. 2, 2015, issued by the Korean Intellectual Property Office in counterpart Korean Application No. 10-2009-0032756.
Communication dated Jun. 2, 2015, issued by the Korean Intellectual Property Office in counterpart Korean Application No. 10-2009-0032758.
Communication dated Dec. 23, 2015, issued by the Korean Intellectual Property Office in counterpart Korean Application No. 10-2009-0032756.
Communication dated Dec. 16, 2015, issued by the Korean Intellectual Property Office in counterpart Korean Application No. 10-2009-0032757.

* cited by examiner $A_n = \frac{1}{n} A_1$ (n ODD NUMBER)

$A_n = \frac{1}{n} A_1$ $A_n = \frac{1}{n^2} A_1$ (n ODD NUMBER)

$$T(t) = \begin{bmatrix} T_1(t) & 0 \le t < t_1 \\ T_2(t) & t_1 \le t < t_2 \\ T_3(t) & t_2 \le t < t_3 \\ T_4(t) & t_3 \le t < t_4 \end{bmatrix}$$

METHOD AND APPARATUS FOR PROCESSING AUDIO SIGNALS USING MOTION OF A SOUND SOURCE, REVERBERATION PROPERTY, OR SEMANTIC OBJECT

CROSS-REFERENCE TO RELATED PATENT APPLICATION

This application is a National Stage application under 35 U.S.C. §371 of PCT/KR2009/001988 filed on Apr. 16, 2009, which claims priority from U.S. Provisional Patent Application No. 61/071,213, filed on Apr. 17, 2008 in the U.S. Patent and Trademark Office, and Korean Patent Application No. 10-2009-0032756, filed on Apr. 15, 2009 in the Korean Intellectual Property Office, all the disclosures of which are incorporated herein in their entireties by reference.

BACKGROUND

1. Field

Apparatuses and methods consistent with exemplary embodiments relate to processing an audio signal, and more particularly, to processing an audio signal in which an audio signal is encoded, decoded, searched, or edited by using motion of a sound source, reverberation property, or semantic object, of which information is included in the audio signal.

2. Description of the Related Art

A method of compressing or encoding an audio signal may be classified into a transformation-based audio signal encoding method and a parameter-based audio signal encoding method. In the transformation-based audio signal encoding method, an audio signal is frequency-transformed, and frequency domain coefficients are encoded and compressed. In the parameter-based audio signal encoding method, all audio signals are grouped into three types of parameters, such as a tone signal, a noise signal, and a transient signal, and the three types of parameters are encoded and compressed.

However, the transformation-based audio signal encoding method processes a large amount of information, and uses separate metadata for controlling semantic media. In addition, in the parameter-based audio signal encoding method, connection with a high level semantic descriptor for controlling semantic media is difficult, audio signals to be expressed as noise have various kinds and wide ranges, and performing high-quality coding is difficult.

Active research has been conducted into multichannel (e.g., 22.2 ch) in an audio field in order to correspond to ultra definition (UD). Home audio systems have different configurations according to environments. Thus, there is a need to efficiently perform down-mixing on a multichannel audio signal according to a home audio system. When an audio signal generated by a moving sound source is down-mixed to have a lower number of channels than the generated audio signal, since speakers are spaced apart from each other, a sound generated by the moving sound source may not be smoothly expressed.

Research has been conducted into technologies in which a listener may listen to a stereoscopic sound by estimating position information about a sound source from an audio signal, distributing output to a plurality of speakers according to the position information, and outputting the audio signal accordingly. In this case, since the position information is estimated on the assumption that the sound source is fixed, only restrictive motion of the sound source may be expressed, and entire position information for each frame is included in the position information. Thus, an amount of data may be increased.

In addition, there is a need for technologies in which a listener may have sense of realism of a concert hall or a theater by using information about acoustic properties, i.e., the reverberation property of a space such as the concert hall or the theater, although the listener is not in the concert hall or the theater. However, when a new reverberation property is applied to an original audio signal, since another reverberation effect is added to the original audio signal although the original audio signal has a reverberation component, an original reverberation component may be interfered with by a new reverberation component.

To overcome this problem, research has been conducted into a method of estimating a reverberation component in an audio signal, dividing the audio signal into a component with the reverberation component and a component without reverberation component, and encoding and transmitting the audio signal. In this case, since it is difficult to correctly estimate the reverberation component from the audio signal, it is difficult to completely extract only a sound generated by a sound source, and thus interference between an original reverberation component and a new reverberation may not be completely removed.

SUMMARY

According to an aspect of an exemplary embodiment, there is provided a method of encoding an audio signal, the method including: receiving an audio signal including information about a moving sound source; receiving position information about the moving sound source; generating dynamic track information indicating motion of the moving sound source by using the position information; and encoding the audio signal and the dynamic track information.

The dynamic track information may include a plurality of points for expressing a dynamic track indicating motion of a position of the moving sound source.

The dynamic track may be a Bézier curve using the plurality of points as control points.

The dynamic track information may include a number of frames to which the dynamic track is applied.

According to an aspect of another exemplary embodiment, there is provided a method of decoding an audio signal, the method including: receiving a signal formed by encoding an audio signal including information about a moving sound source and dynamic track information indicating motion of a position of the moving sound source; and decoding the audio signal and the dynamic track information from the received signal.

The method may further include distributing output to a plurality of speaker so as to correspond to the dynamic track information.

The method may further include changing a frame rate of the audio signal by using the dynamic track information.

The method may further include changing a number of channels of the audio signal by using the dynamic track information.

The method may further include searching the audio signal for a period corresponding to a predetermined motion property of the sound source by using the dynamic track information.

The dynamic track information may include a plurality of points for expressing a dynamic track indicating motion of a position of the sound source, and the searching may be performed by using the plurality of points.

The dynamic track information may include a number of frames to which the dynamic track is applied, and the searching may be performed by using the number of the frames.

According to an aspect of another exemplary embodiment, there is provided a method of encoding an audio signal, the method including: receiving an audio signal; separately receiving a reverberation property of the audio signal; and encoding the audio signal and the reverberation property.

The audio signal may be recorded in a predetermined space, and the reverberation property may be of the predetermined space.

The reverberation property may be indicated by an impulse response.

The encoding may include encoding the audio signal so that an initial reverberation period of the impulse response is expressed in a type of a high-degree infinite impulse response (IIR) filter, and a latter reverberation period of the impulse response is expressed in a type of a low-degree infinite impulse response filter.

According to an aspect of another exemplary embodiment, there is provided a method of decoding an audio signal, the method including: receiving a signal formed by encoding an audio signal including a first reverberation property and the first reverberation property; and decoding the audio signal from the received signal.

The method may further include: decoding the first reverberation property from the received signal; calculating a reversed function of the first reverberation property; and obtaining an audio signal from which the first reverberation property is removed by applying the reversed function to the audio signal.

The method may further include: receiving a second reverberation property; and generating an audio signal including the second reverberation property by applying the second reverberation property to the audio signal from which the first reverberation property is removed.

The receiving the second reverberation property may include receiving the second reverberation property input by a user from an input device, or receiving the second reverberation property that is previously stored in a memory, from the memory.

The audio signal may be recorded in a predetermined space, and the first reverberation property may be of the predetermined space.

According to an aspect of another exemplary embodiment, there is provided a method of encoding an audio signal, the method including: receiving an audio signal recorded in a predetermined space; receiving a reverberation property of the predetermined space; calculating a reversed function of the reverberation property; obtaining an audio signal from which the reverberation property is removed by applying the reversed function to the audio signal; and encoding the reverberation property and the audio signal from which the reverberation property is removed.

According to an aspect of another exemplary embodiment, there is provided a method of decoding an audio signal, the method including: receiving a signal formed by encoding an audio signal and a reverberation property; decoding the audio signal from the received signal; decoding the reverberation property from the received signal; and obtaining an audio signal including the reverberation property by applying the reverberation property to the audio signal.

According to an aspect of another exemplary embodiment, there is provided a method of decoding an audio signal, the method including: receiving a signal formed by encoding an audio signal and a first reverberation property; decoding the audio signal from the received signal; receiving a second reverberation property; and generating an audio signal including the second reverberation property by applying the second reverberation property to the audio signal.

According to an aspect of another exemplary embodiment, there is provided a method of encoding an audio signal, the method including: receiving at least one parameter indicating at least one property of a semantic object of the audio signal; and encoding the at least one parameter.

The at least one parameter may include at least one of: a note list for indicating pitch and beat of the semantic object; a physical model for indicating physical property of the semantic object; and an actuating signal for actuating the semantic object.

The physical model may include a transfer function that is a ratio between an output signal and the actuating signal in a frequency domain.

The encoding may include encoding a coefficient in a frequency domain of the actuating signal.

The encoding may include encoding coordinates of a plurality of points in a time domain of the actuating signal.

The at least one parameter may include position information indicating a position of the semantic object.

The at least one parameter may include spatial information indicating a reverberation property of a space where an audio signal of the semantic object is generated.

The method may further include receiving spatial information indicating a reverberation property of a space where the audio signal is generated, and the encoding may include encoding the at least one parameter including the spatial information.

The spatial information may include an impulse response exhibiting the reverberation property.

According to an aspect of another exemplary embodiment, there is provided a method of decoding an audio signal, the method including: receiving an input signal formed by encoding at least one parameter indicating property of a semantic object of an audio signal; and decoding the at least one parameter from the input signal.

The method may further include restoring the audio signal by using the at least one parameter.

The at least one parameter may include at least one of: a note list for indicating pitch and beat of the semantic object; a physical model for indicating physical property of the semantic object; and an actuating signal for actuating the semantic object.

The at least one parameter may include position information indicating a position of the semantic object.

The method may further include distributing output to a plurality of speaker so as to correspond to the dynamic track information.

The at least one parameter may include spatial information indicating a reverberation property of a space where an audio signal of the semantic object is generated.

The input signal may be formed by encoding spatial information indicating a reverberation property of a space where the audio signal is generated, and the method may further include decoding the spatial information from the input signal.

The method may further include restoring the audio signal by using the at least one parameter and the spatial information.

The method may further include processing the at least one parameter.

The processing may include searching for a parameter corresponding to a predetermined audio property from among the at least one parameter.

The processing may include editing the at least one parameter.

The method may further include generating an edited audio signal edited by using the edited parameter.

The editing the at least one parameter may include deleting the semantic object from an audio signal, inserting a new semantic object into the audio signal, or replacing the semantic object of the audio signal with the new semantic object.

The editing the at least one parameter may include deleting a parameter, inserting a new parameter into the audio signal, or replacing the parameter with the new parameter.

According to an aspect of another exemplary embodiment, there is provided an apparatus for encoding an audio signal, the apparatus including: a receiver which receives an audio signal including information about a moving sound source and position information about the moving sound source; a dynamic track information generator which generates dynamic track information indicating motion of the moving sound source by using the position information; and an encoder which encodes the audio signal and the dynamic track information.

The dynamic track information may include a plurality of points for expressing a dynamic track indicating motion of a position of the moving sound source.

The dynamic track may be a Bézier curve using the plurality of points as control points.

The dynamic track information may include a number of frames to which the dynamic track is applied.

According to an aspect of another exemplary embodiment, there is provided an apparatus for decoding an audio signal, the apparatus including: a receiver which receives a signal formed by encoding an audio signal including information about a moving sound source and dynamic track information indicating motion of a position of the moving sound source; and a decoder which decodes the audio signal and the dynamic track information from the received signal.

The apparatus may further include an output distributor which distributes output to a plurality of speaker so as to correspond to the dynamic track information.

The decoder may change a frame rate of the audio signal by using the dynamic track information.

The decoder may change a number of channels of the audio signal by using the dynamic track information.

The decoder may search the audio signal for a period corresponding to predetermined motion property of the moving sound source by using the dynamic track information.

The dynamic track information may include a plurality of points for expressing a dynamic track indicating motion of a position of the moving sound source, and the decoder may search the audio signal by using the plurality of points.

The dynamic track information may include a number of frames to which the dynamic track is applied, and the decoder may search the audio signal by using the number of the frames.

According to an aspect of another exemplary embodiment, there is provided an apparatus for encoding an audio signal, the apparatus including: a receiver which receives an audio signal and a reverberation property of the audio signal; and a encoder which encodes the audio signal and the reverberation property.

The audio signal may be recorded in a predetermined space, the reverberation property may be of the predetermined space, and the reverberation property may be indicated by an impulse response.

The encoder may encode the audio signal so that an initial reverberation period of the impulse response is expressed in a type of a high-degree infinite impulse response (IIR) filter, and a latter reverberation period of the impulse response is expressed in a type of a low-degree infinite impulse response filter.

According to an aspect of another exemplary embodiment, there is provided an apparatus for decoding an audio signal, the apparatus including: a receiver which receives a signal formed by encoding an audio signal including a first reverberation property and the first reverberation property; and a decoder which decodes the audio signal from the received signal.

The apparatus may further include a reverberation remover which decodes the first reverberation property from the received signal, calculates a reversed function of the first reverberation property, and obtains an audio signal from which the first reverberation property is removed by applying the reversed function to the audio signal.

The apparatus may further include a reverberation applier which receives a second reverberation property, and which generates an audio signal including the second reverberation property by applying the second reverberation property to the audio signal from which the first reverberation property is removed.

The receiver may receive the second reverberation property input by a user from an input device, or may receive the second reverberation property that is previously stored in a memory, from the memory.

The audio signal may be recorded in a predetermined space, and the first reverberation property may be of the predetermined space.

According to an aspect of another exemplary embodiment, there is provided an apparatus for encoding an audio signal, the apparatus including: a receiver which receives an audio signal recorded in a predetermined space, and a reverberation property of the predetermined space; a reverberation remover which calculates a reversed function of the reverberation property, and obtains an audio signal from which the reverberation property is removed by applying the reversed function to the audio signal; and an encoder which encodes the audio signal from which the reverberation property is removed, and the reverberation property.

According to an aspect of another exemplary embodiment, there is provided an apparatus for decoding an audio signal, the apparatus including: a receiver which receives a signal formed by encoding an audio signal and reverberation property; a decoder which decodes the audio signal and the reverberation property from the received signal; and a reverberation restorer which obtains an audio signal including the reverberation property by applying the reverberation property to the audio signal.

According to an aspect of another exemplary embodiment, there is provided an apparatus for decoding an audio signal, the apparatus including: a receiver which receives a signal formed by encoding an audio signal and first reverberation property, and a second reverberation property; a decoder which decodes the audio signal from the received signal; and a reverberation applier which generates an audio signal including the second reverberation property by applying the second reverberation property to the audio signal.

According to an aspect of another exemplary embodiment, there is provided an apparatus for encoding an audio signal, the apparatus including: a receiver which receives at least one parameter indicating at least one property of a semantic object of the audio signal; and an encoder which encodes the at least one parameter.

The at least one parameter may include at least one of: a note list for indicating pitch and beat of the semantic object;

a physical model for indicating a physical property of the semantic object; and an actuating signal for actuating the semantic object.

The physical model may include a transfer function that is a ratio between an output signal and the actuating signal in a frequency domain, with regard to the semantic object.

The encoder may encode a coefficient in a frequency domain of the actuating signal.

The encoder may encode coordinates of a plurality of points in a time domain of the actuating signal.

The at least one parameter may include position information indicating a position of the semantic object.

The at least one parameter may include spatial information indicating a reverberation property of a space where the audio signal of the semantic object is generated.

The receiver may receive spatial information indicating a reverberation property of a space where the audio signal is generated, and the encoder may encode the at least one parameter including the spatial information.

The spatial information may include an impulse response exhibiting the reverberation property.

According to an aspect of another exemplary embodiment, there is provided an apparatus for decoding an audio signal, the apparatus including: a receiver which receives an input signal formed by encoding at least one parameter indicating at least one property of a semantic object of an audio signal; and a decoder which decodes the at least one parameter from the input signal.

The apparatus may further include a restorer which restores the audio signal by using the at least one parameter.

The at least one parameter may include at least one of: a note list for indicating pitch and beat of the semantic object; a physical model for indicating a physical property of the semantic object; and an actuating signal for actuating the semantic object.

The at least one parameter may include position information indicating a position of the semantic object.

The apparatus may further include an output distributor which distributes output to a plurality of speaker so as to correspond to the dynamic track information.

The at least one parameter may include spatial information indicating a reverberation property of a space where an audio signal of the semantic object is generated.

The input signal may be formed by encoding spatial information indicating a reverberation property of a space where the audio signal is generated, and is encoded, and the decoder may decode the spatial information from the input signal.

The apparatus may further include a restorer which restores the audio signal by using the at least one parameter and the spatial information.

The apparatus may further include a processor which processes the at least one parameter.

The processor may include a searcher which searches for a parameter corresponding to a predetermined audio property from among the at least one parameter.

The processor may include an editor which edits the at least one parameter.

The apparatus may further include a generator which generates an edited audio signal by using the edited parameter.

The editor may delete the semantic object from the audio signal, may insert a new semantic object into the audio signal, or may replace the semantic object of the audio signal with the new semantic object.

The editor may delete a parameter, may insert a new parameter into the audio signal, or may replace the parameter with a new parameter.

DETAILED DESCRIPTION OF EXEMPLARY EMBODIMENTS

Figure 1:
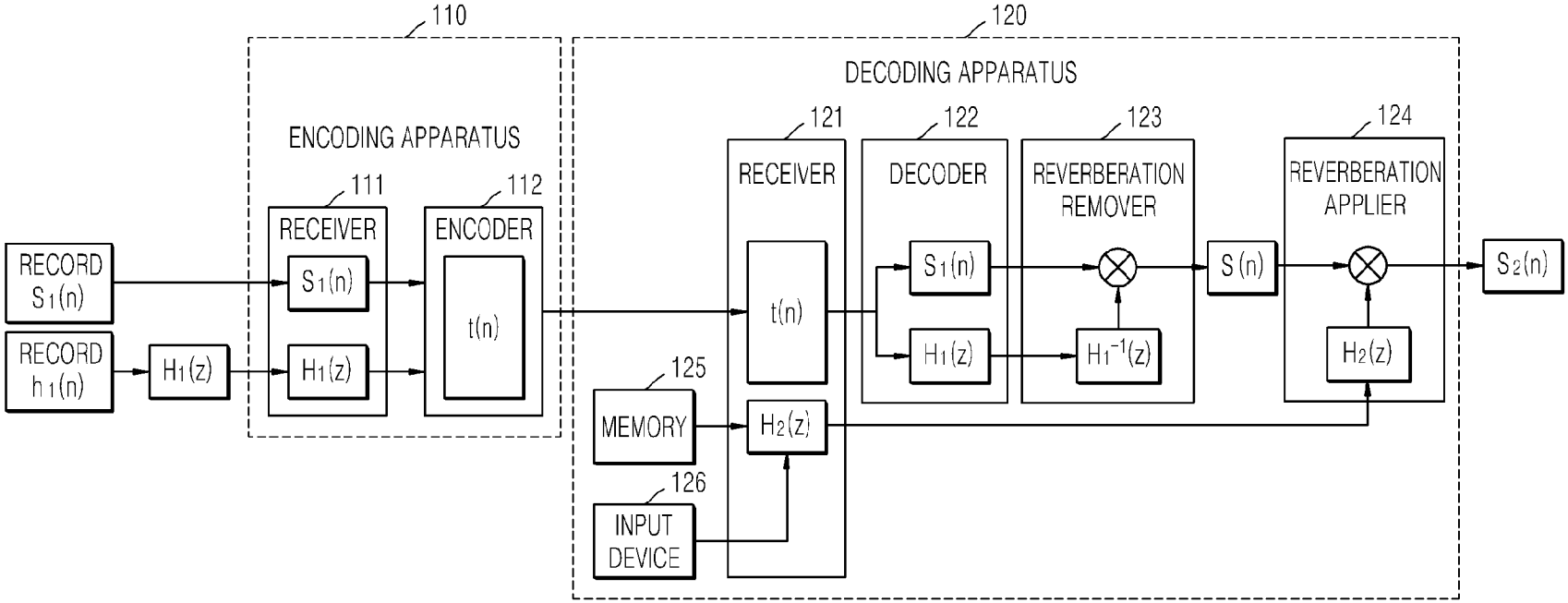
FIG. 1 is a block diagram of an apparatus for encoding an audio signal and an apparatus for decoding an audio signal, for processing reverberation, according to one or more exemplary embodiments.

Exemplary embodiments will now be described more fully with reference to the accompanying drawings. In the following description of the exemplary embodiments, only essential parts for an understanding of an operation of the exemplary embodiments will be explained and other parts will not be explained when it is deemed that they make unnecessarily obscure the subject matter of the exemplary embodiments. For convenience of description, a method and an apparatus are described together, if necessary.

Reference will now be made in detail to exemplary embodiments with reference to the accompanying drawings. In the drawings, the same numeral denotes the same element, and sizes of elements may be exaggerated for clarity. In addition, it is noted that the same component can be described with reference to all the drawings. Furthermore, expressions such as "at least one of," when preceding a list of elements, modify the entire list of elements and do not modify the individual elements of the list.

Encoding and Decoding Audio Signal Using Spatial Information

FIG. 1 is a block diagram of an apparatus 110 for encoding an audio signal and an apparatus 120 for decoding an audio signal, for processing reverberation, according to one or more exemplary embodiments.

Referring to FIG. 1, the encoding apparatus 110 for processing reverberation according to an exemplary embodiment includes a receiver 111 and an encoder 112. The receiver 111 receives an audio signal $S_1(n)$ recorded in a space and a reverberation property $H_1(z)$ of the space. In this case, the audio signal $S_1(n)$ may be obtained by recording an original audio signal S(n) that has no reverberation component in the space, and has the reverberation property $H_1(z)$ of the space.

According to an exemplary embodiment, the reverberation property $H_1(z)$ of the space may be indicated by an impulse response. Hereinafter, the impulse response $H_1(z)$ or the reverberation property $H_1(z)$ will be used, representing the acoustic property of the space. In order to obtain the impulse response $H_1(z)$, when a high-energy signal (e.g., a signal similar to an impulse signal, such as a gunshot signal) is generated in the space, a responding sound in the space is recorded to obtain an impulse response $h_1(n)$ of a time domain, and the obtained impulse response $h_1(n)$ is transformed to obtain the impulse response $H_1(z)$ of a frequency domain. For example, the impulse response $H_1(z)$ may be embodied as a finite impulse response (FIR), or an infinite impulse response (IIR).

According to an exemplary embodiment, the impulse response $H_1(z)$ may be embodied as the IIR represented by Equation 1 below:

$$H_1(Z) = \frac{\sum_{j=1}^{N} b_j z^{-j}}{1 + \sum_{k=1}^{M} a_k z^{-k}}, \tag{1}$$

where coefficients $a_1, a_2, \ldots, a_M, b_1, b_2, \ldots, b_N$ are encoded by the encoder 112, which will be described later. In addition, as M and N increase, the reverberation property $H_1(z)$ may be more sufficiently expressed. According to an exemplary embodiment, M and N in an initial reverberation period (e.g., within 0.4 seconds) are increased to sufficiently express the reverberation property, and M and N in the remaining latter period are reduced so as to reduce an amount of data.

According to another exemplary embodiment, the initial reverberation period of the impulse response $H_1(z)$ may be expressed in a FIR type, and the latter reverberation period of the impulse response $H_1(z)$ may be expressed in an IIR type.

Alternatively, the audio signal $S_1(n)$ and the reverberation property $H_1(z)$ may be generated by mechanically generating a sound with software or hardware, instead of recording a real sound.

The encoder 112 encodes the audio signal $S_1(n)$ and the reverberation property $H_1(z)$, and transmits a signal t(n) generated by encoding the audio signal $S_1(n)$ and the reverberation property $H_1(z)$ to the decoding apparatus 120. The audio signal $S_1(n)$ and the reverberation property $H_1(z)$ may be encoded together or separately. When the audio signal $S_1(n)$ and the reverberation property $H_1(z)$ are encoded together, the reverberation property $H_1(z)$ may be inserted into the signal t(n) in various manners, such as in metadata, a mode, header information, etc. Any encoding method that is well known to one of ordinary skill in the art may be used in exemplary embodiments. However, it is deemed that the detailed description of the encoding method may unnecessarily obscure the subject matter of the exemplary embodiments, and thus the encoding method will not be described herein for convenience of description of the exemplary embodiments.

The decoding apparatus 120 according to an exemplary embodiment includes a receiver 121, a decoder 122, a reverberation remover 123, a reverberation applier 124, a memory 125, and an input device 126.

The receiver 121 receives the signal t(n) encoded by the encoder 112, and receives a desired reverberation property $H_2(z)$ from a user. According to an exemplary embodiment, the receiver 121 may receive the desired reverberation property $H_2(z)$ that is input to the input device 126 by the user, from the input device 126, though it is understood that another exemplary embodiment is not limited thereto. For example, according to another exemplary embodiment, the receiver 121 may receive the desired reverberation property $H_2(z)$ from the memory 125 from among various reverberation properties that are previously stored in the memory 125.

The decoder 122 decodes the audio signal $S_1(n)$ and the reverberation property $H_1(z)$ from the signal t(n). A decoding method corresponds to the encoding method used in the apparatus 110. In addition, any decoding method that is well known to one of ordinary skill in the art may be used as the decoding method, and thus will not be described herein for convenience of description of the exemplary embodiments.

The reverberation remover 123 calculates a reversed function $H1^{-1}(z)$ of the reverberation property $H_1(z)$, and applies the reversed function $H1^{-1}(z)$ to the audio signal $S_1(n)$ so as to obtain the original audio signal S(n) from which the reverberation property $H_1(z)$ is removed. The reverberation applier 124 applies the desired reverberation property $H_2(z)$ to the original audio signal S(n) so as to generate an audio signal $S_2(n)$ having the desired reverberation property $H_2(z)$.

As described above, a high-quality reverberation effect without interference between different reverberation properties may be obtained by completely removing the reverberation property of a predetermined space from an audio signal recorded in the predetermined space and adding a desired reverberation property of a user to the audio signal. Thus, a listener may experience a sense of realism of a particular space, e.g., world-famous concert hall or a preferred space of the listener.

Figure 2:
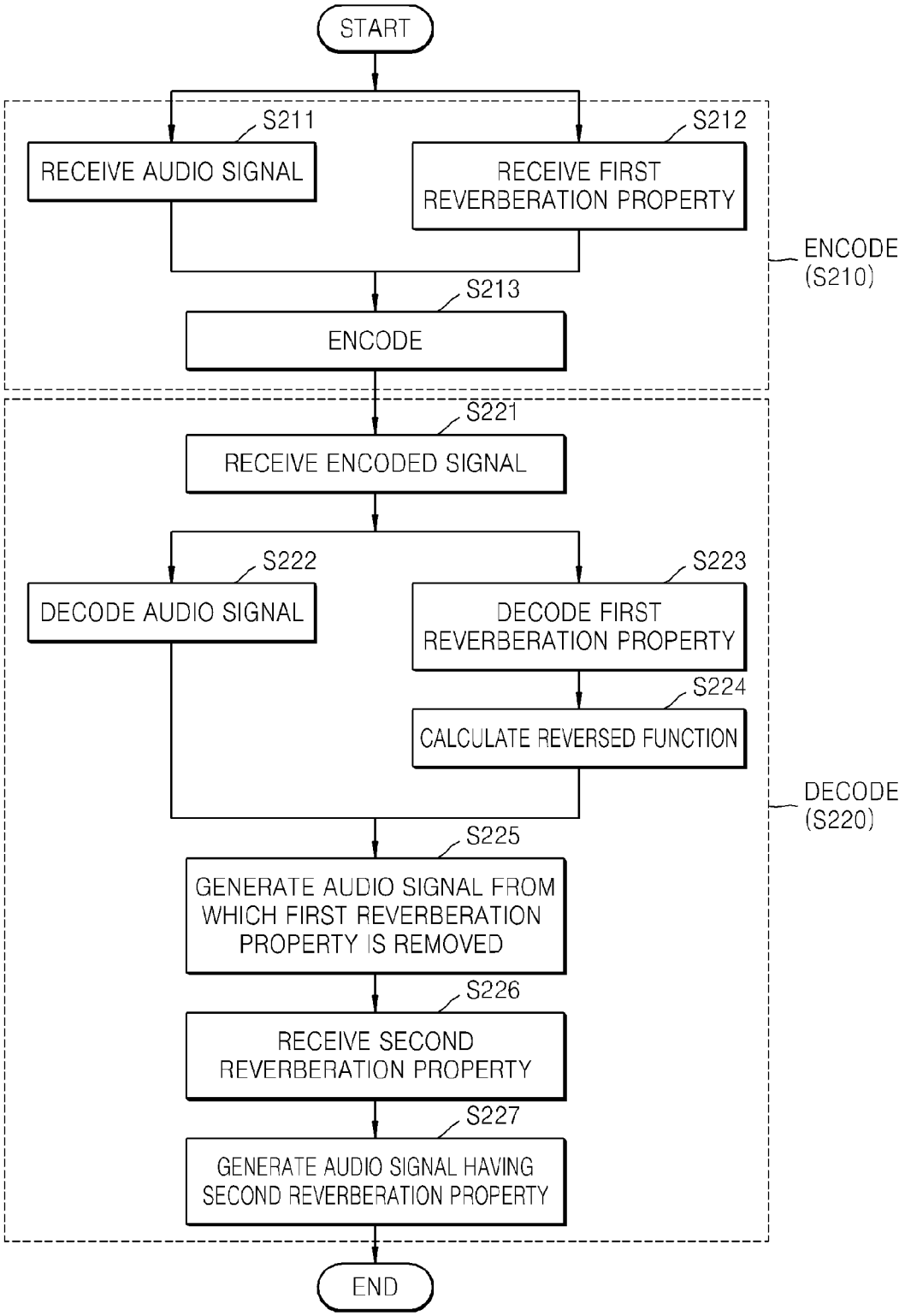
FIG. 2 is a flowchart of methods of encoding and decoding an audio signal for processing reverberation, according to one or more exemplary embodiments.

FIG. 2 is a flowchart of methods S210 and S220 of encoding and decoding an audio signal for processing reverberation, according to one or more exemplary embodiments.

Referring to FIG. 2, the method S210 of encoding an audio signal for processing reverberation according to an exemplary embodiment includes receiving the audio signal $S_1(n)$ recorded in a space (operation S211), receiving a first reverberation property that is a reverberation property $H_1(z)$ of the space (operation S212), and encoding the audio signal S1(*n*) and the reverberation property $H_1(z)$ to generate a signal t(n) (operation S213).

The method S220 of decoding an audio signal for processing reverberation according to an exemplary embodiment includes receiving the signal t(n) (operation S221), decoding the audio signal $S_1(n)$ from the signal t(n) (operation S222), decoding the first reverberation property that is the reverberation property $H_1(z)$ of the space from the signal t(n) (operation S223), calculating a reversed function $H1^{-1}(z)$ of the reverberation property $H_1(z)$ (operation S224), generating the original audio signal S(n) from which the reverberation property $H_1(z)$ is removed by applying the reversed function $H1^{-1}(z)$ to the audio signal $S_1(n)$ (operation S225), receiving a desired reverberation property $H_2(z)$ (operation S226), and generating the audio signal $S_2(n)$ having the desired reverberation property $H_2(z)$ by applying the desired reverberation property $H_2(z)$ to the original audio signal S(n) that has no reverberation property $H_1(z)$ (operation S227). The audio signal $S_1(n)$, the reverberation property $H_1(z)$, the desired reverberation property $H_2(z)$, etc., have been described above, and thus will not be repeated herein. The above-described operations may not be sequentially performed, and may be performed in parallel or selectively.

Figure 3:
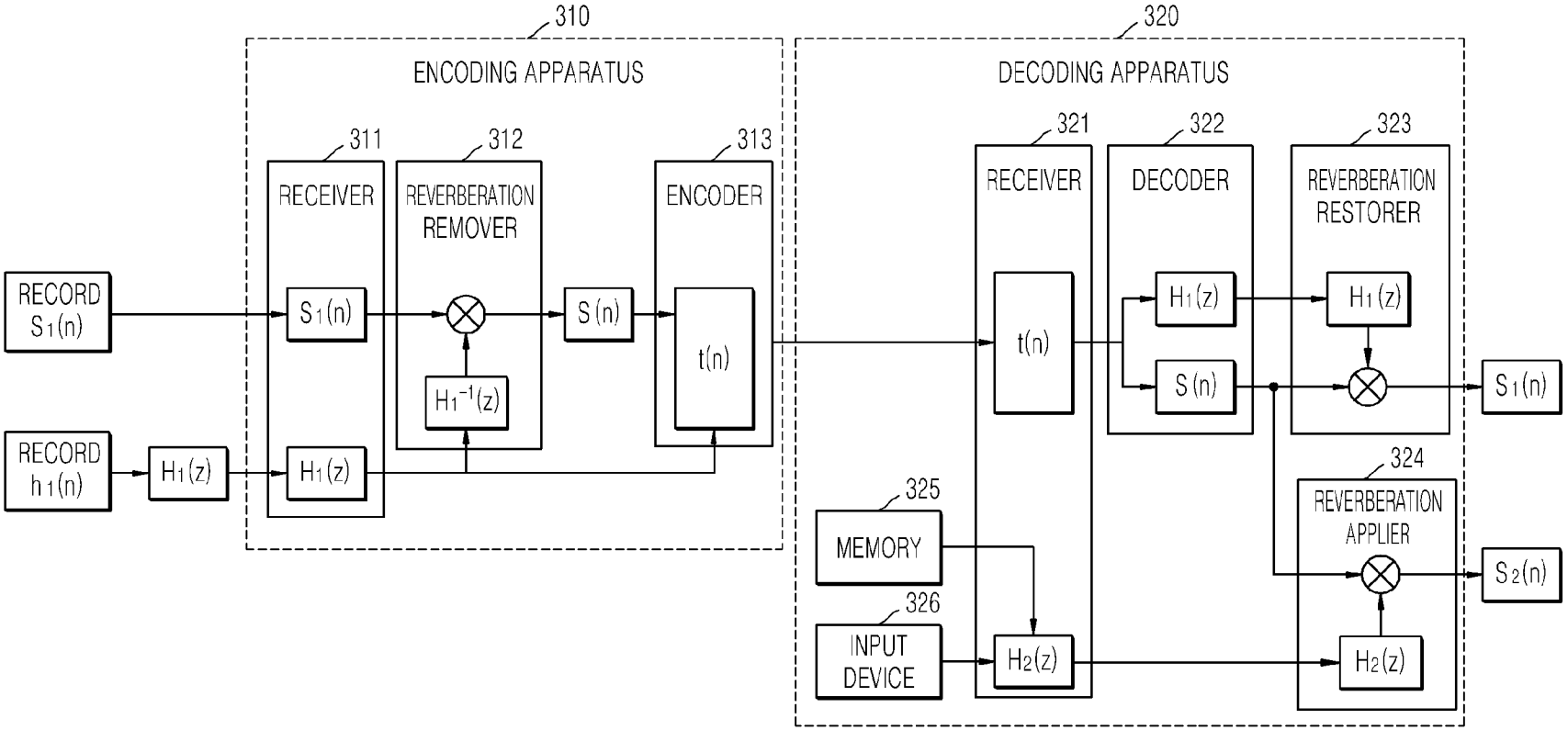
FIG. 3 is a block diagram of an apparatus for encoding an audio signal and an apparatus for decoding an audio signal, for processing reverberation, according to one or more exemplary embodiments.

FIG. 3 is a block diagram of an apparatus 310 for encoding an audio signal and an apparatus 320 for decoding an audio signal, for processing reverberation, according to one or more exemplary embodiments.

Referring to FIG. 3, the encoding apparatus 310 for processing reverberation according to an exemplary embodiment includes a receiver 311, a reverberation remover 312, and an encoder 313. The receiver 311 receives an audio signal $S_1(n)$ recorded in a space, and a reverberation property $H_1(z)$ of the space.

The reverberation remover 312 calculates the reversed function $H1^{-1}(z)$ of the reverberation property $H_1(z)$, and applies the reversed function $H1^{-1}(z)$ to the audio signal $S_1(n)$ to obtain the original audio signal S(n) from which the reverberation property $H_1(z)$ is removed. The encoder 313 encodes the original audio signal S(n) and the reverberation property $H_1(z)$, and transmits the signal t(n) generated by encoding the original audio signal S(n) and the reverberation property $H_1(z)$ to the apparatus 320 for decoding an audio signal according to an exemplary embodiment. The original audio signal S(n) and the reverberation property $H_1(z)$ may be encoded together or separately.

The apparatus 320 may include a receiver 321, a decoder 322, a reverberation restorer 323, a reverberation applier 324, a memory 325, and an input device 326.

The receiver 321 receives the signal t(n) encoded by the encoder 313 and a desired reverberation property $H_2(z)$. According to an exemplary embodiment, the receiver 321 may receive the desired reverberation property $H_2(z)$ that is input to the input device 326 by a user, from the input device 326. Alternatively, the receiver 321 may receive the desired reverberation property $H_2(z)$ from the memory 325 from among various reverberation properties that are previously stored in the memory 325.

The decoder 322 decodes the original audio signal S(n) and the reverberation property $H_1(z)$ from the signal t(n). The reverberation restorer 323 restores the audio signal $S_1(n)$ having the reverberation property $H_1(z)$ of the space by applying the reverberation property $H_1(z)$ to the original audio signal S(n).

The reverberation applier 324 applies the desired reverberation property $H_2(z)$ to the original audio signal S(n) so as to generate the audio signal $S_2(n)$ having the desired reverberation property $H_2(z)$.

As described above, the reverberation property of a predetermined space and an audio signal that has no reverberation property are divided and encoded from an audio signal recorded in the predetermined space, and a signal formed by encoding the reverberation property and the audio signal that has no reverberation property is transmitted to a receiving side. Thus, the receiving side may generate a high-quality audio signal having a desired reverberation property without interference between different reverberation properties.

Figure 4:
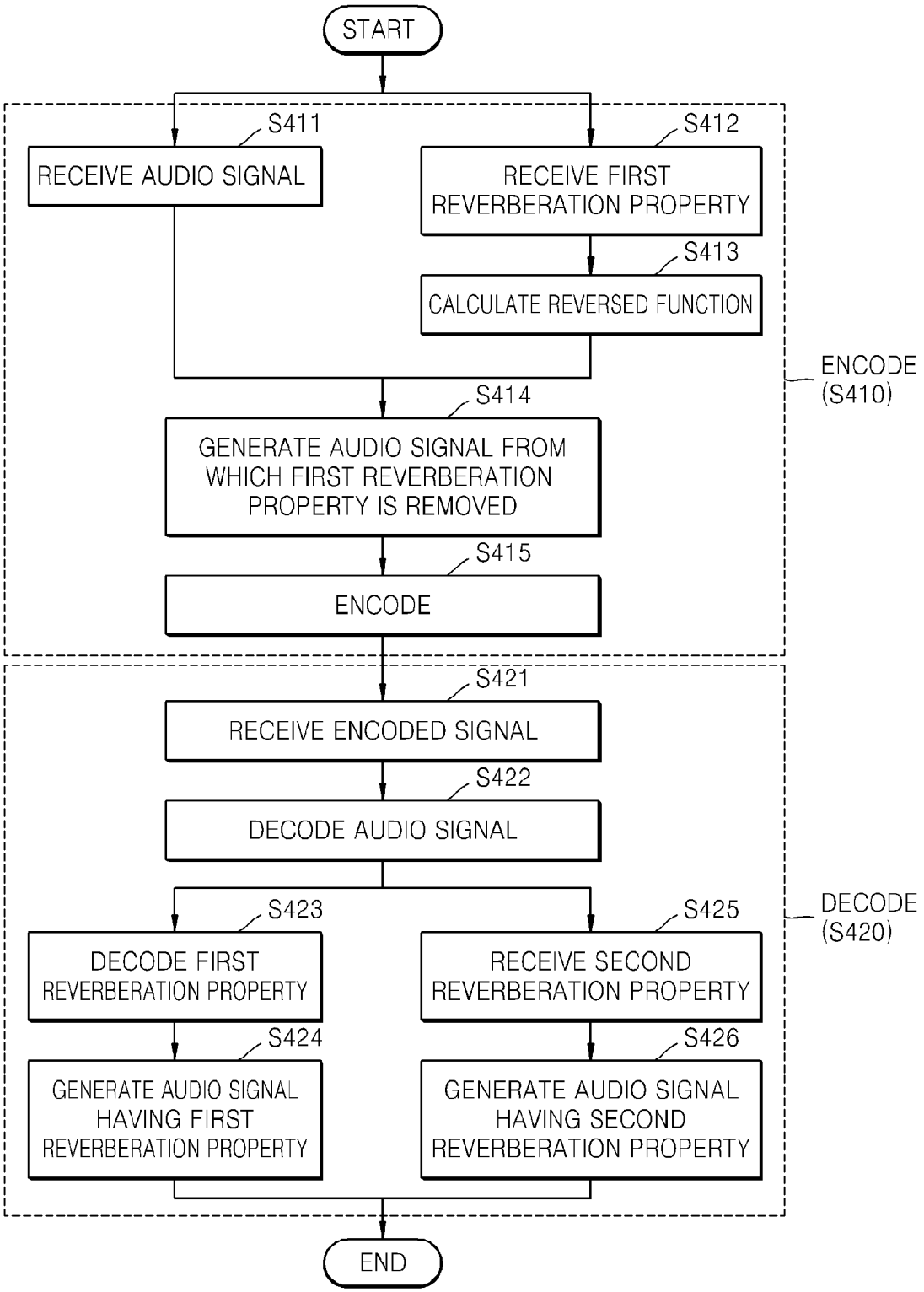
FIG. 4 is a flowchart of methods of encoding and decoding an audio signal for processing reverberation, according to one or more exemplary embodiments.

FIG. 4 is a flowchart of methods S410 and S420 of encoding and decoding an audio signal for processing reverberation, according to one or more exemplary embodiments.

Referring to FIG. 4, the method S410 of encoding an audio signal for processing reverberation according to an exemplary embodiment includes receiving the audio signal $S_1(n)$ recorded in a space (operation S411), receiving a first reverberation property that is a reverberation property $H_1(z)$ of the space (S412), calculating a reversed function $H1^{-1}(z)$ of the reverberation property $H_1(z)$ (operation S413), generating the original audio signal S(n) from which the reverberation property $H_1(z)$ is removed by applying the reversed function $H1^{-1}(z)$ to the audio signal $S_1(n)$ (operation S414), and encoding the original audio signal S(n) and the reverberation property $H_1(z)$ to generate a signal t(n) (operation S415).

The method S420 of decoding an audio signal for processing reverberation according to an exemplary embodiment includes receiving the signal t(n) (operation S421), decoding the original audio signal S(n) from which the reverberation property $H_1(z)$ is removed from the signal t(n) (operation S422), decoding the reverberation property $H_1(z)$ of the space from the signal t(n) (operation S423), generating the audio signal $S_1(n)$ having the reverberation property $H_1(z)$ by applying the reverberation property $H_1(z)$ to the original audio signal S(n) (operation S424), receiving a desired reverberation property $H_2(z)$ (operation S425), and generating an audio signal $S_2(n)$ having the desired reverberation property $H_2(z)$ by applying the desired reverberation property $H_2(z)$ to the original audio signal S(n) that has no reverberation property $H_1(z)$ (operation S426). The above-described operations may not be sequentially performed, and may be performed in parallel or selectively.

Figure 5A:
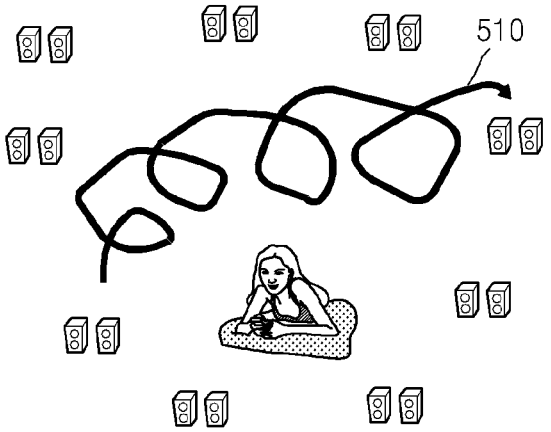
FIGS. 5A through 5C are diagrams for explaining a principle of encoding an audio signal using a dynamic track of a moving sound source, according to one or more exemplary embodiments.
Figure 5B:
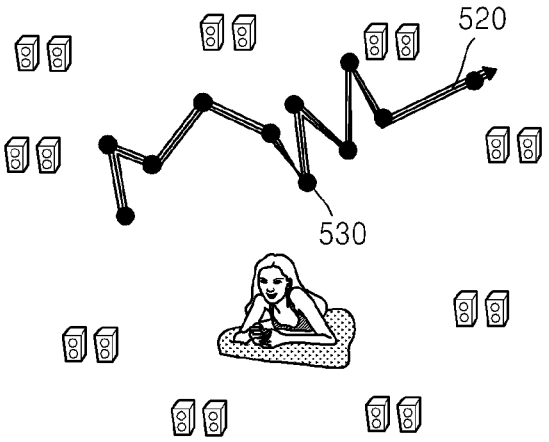
Figure 5C:
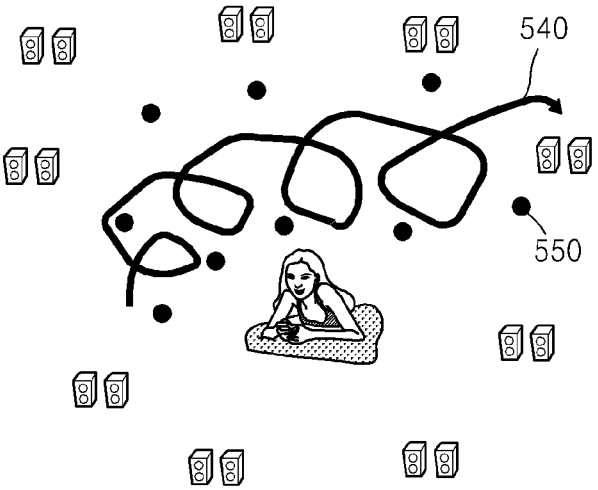

Encoding and Decoding Audio Signal by Using Dynamic Track of Moving Sound Source FIGS. 5A through 5C are diagrams for explaining a principle of encoding an audio signal by using a dynamic track of a moving sound source, according to one or more exemplary embodiments.

FIG. 5A illustrates a motion 510 of the sound source that, for example, is to be expressed by a contents manufacturer on the assumption that a user uses a high-performance decoding apparatus and many speakers. FIG. 5B illustrates a case where a signal about a position 530 of the sound source is sampled and encoded according to a predetermined frame rate. In this case, for position information, the encoded signal only has position information that is sampled at predetermined intervals, and thus only restrictive motion may be expressed. Specifically, when the sound source moves at rapid speed compared with the frame rate, the sampled position information may not sufficiently express original motion of the sound source. For example, the original motion of the sound source has a spiral form, like the motion 510 of FIG. 5A. In addition, motion of the sound source, included in the encoded signal, may have a zigzag form, like a motion 520 of FIG. 5B. In this case, even though a receiving side increases a frame rate indicating a position of the sound source in order to finely express the motion of the sound source, since there is no information about a relationship between positions, the spiral form of the original motion may not be expressed.

However, when information about continuous motion, i.e., information about the dynamic track of the sound source, is used, instead of the sampled information about the position of the sound source, in order to express the original motion of the sound source, curved portions of the dynamic track of the sound source, which cannot be expressed in a case of FIG. 5B, may be correctly expressed like a motion 540 illustrated in FIG. 5C. Thus, the motion 510 of the sound source, which is to be expressed by the contents manufacturer, may be reproduced, and as the receiving side increases the frame rate, a position of the sound source may be more correctly reproduced. In addition, a transmitting side encodes a minimum amount of information used to express the dynamic track of the moving sound source, instead of encoding entire position information for each frame. Thus, an amount of data may be reduced.

Home audio systems may be different according to environments. Thus, a first multichannel audio signal may be transformed to a second multichannel audio signal having a lower number of channels than the first multichannel audio signal (for example, an audio signal having 22.2 channels is transformed to an audio signal having 5.1 channels). That is, down-mixing may be performed on the first multichannel audio signal. Thus, according to an exemplary embodiment, when the information about the dynamic track of the sound source is used, since continuous information about the original motion of the sound source may be obtained, the moving sound source may be more smoothly expressed than a case where information about the position of the sound source, which is discretely sampled, is used. For example, when the sound source moves at rapid speed, if motion of the sound source, which is to be expressed in a first multichannel, is expressed in a second multichannel having a lower number of channels than the first multichannel, since an interval between speakers is wide in the second multichannel, a sound may be discretely expressed without any process of a decoder. Thus, if the decoder uses the information about the position of the sound source, which is discretely sampled, and the motion of the sound source, which is to be expressed in the first multichannel, is expressed in the second multichannel having a lower number of channels than the first multichannel, since an interval between speakers is increased in the second multichannel compared with the first multichannel, a range for forming a sound image is physically increased. Furthermore, when the sound source moves at rapid speed, since an interval between sound images formed for respective points of time is increased, the motion of the sound source between the sound images may not be smoothly expressed. However, according to an exemplary embodiment, when the motion of the sound source is expressed, since the decoder may provide information about a sound image that is to be expressed by a manufacturer of the sound source, the motion of the sound source may be efficiently expressed regardless of a moving speed of the sound source or an interval between speakers under an environment having a low number of channels.

According to an exemplary embodiment, the information about the dynamic track of the sound source may be expressed in a plurality of points representing continuous motion of the sound source, for example, a plurality of points 550 as illustrated in FIG. 5C. A method of expressing a continuous dynamic track by using a plurality of points according to an exemplary embodiment will now be described in detail.

Figure 6:
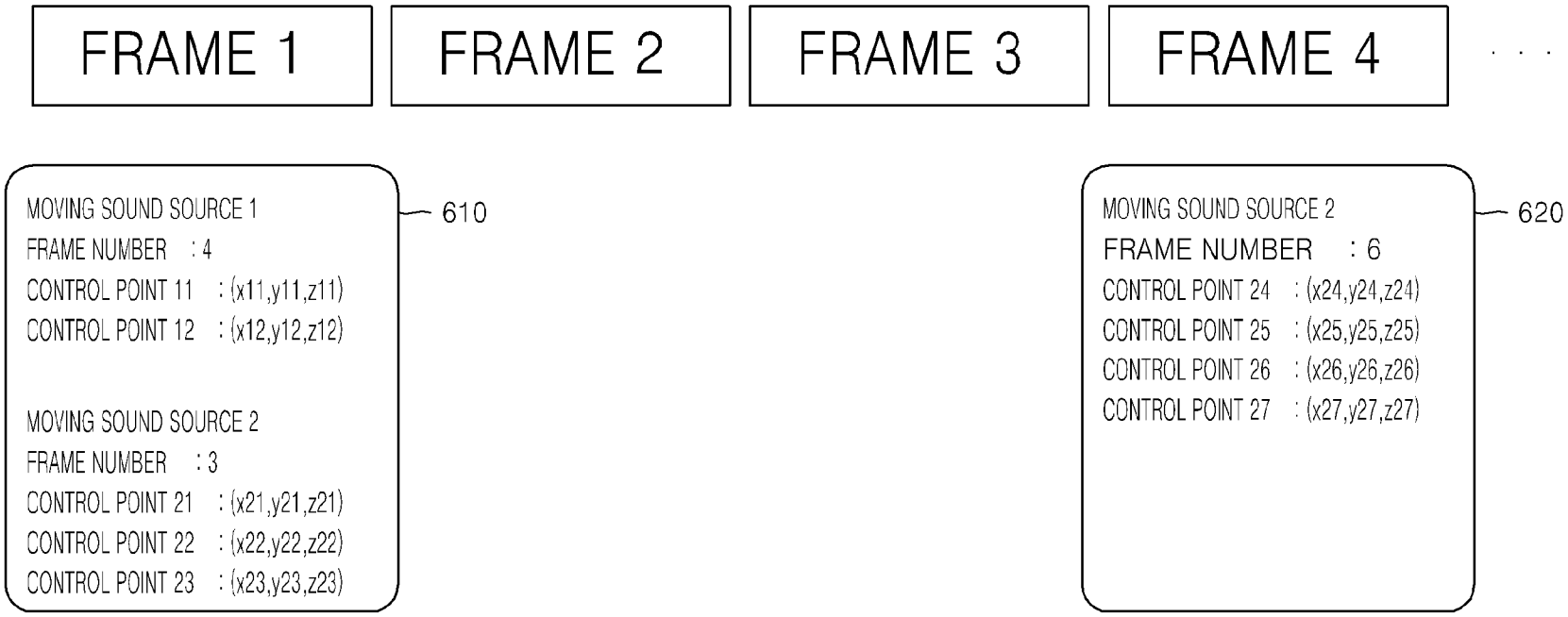
FIG. 6 illustrates information about a dynamic track according to an exemplary embodiment.

FIG. 6 illustrates information about a dynamic track according to an exemplary embodiment. Referring to FIG. 6, information about two moving sound sources exist in an exemplary audio signal, and the two moving sound sources are denoted by a moving sound source 1 and a moving sound source 2. The moving sound source 1 exists from a frame 1 to a frame 4, and a dynamic track from the frame 1 to the frame 4 is expressed by two points, i.e., a control point 11 and a control point 12. Information about a dynamic track of the moving sound source 1 includes the number 4 of frames to which the control point 11, the control point 12, and a dynamic track expressed by the control point 11 and the control point 12 are applied, and is inserted into the frame 1 as additional information 610.

The moving sound source 2 exists from the frame 1 to a frame 9, a dynamic track from the frame 1 to the frame 3 is expressed by three points, i.e., a control point 21 through a control point 23, and a dynamic track from the frame 4 through the frame 9 is expressed by four points, i.e., a control point 24 through a control point 27. Information about the moving sound source 2 of the additional information 620 inserted into the frame 1 includes the number 3 of frames to which the control points 21 through 23 and a dynamic track expressed by the control points 21 through 23 are applied. The information about the moving sound source 2 of the additional information 620 inserted into the frame 1 includes the number 6 of frames to which the control points 24 through 27 and a dynamic track expressed by the control points 24 through 27 are applied.

In this case, as the number of control points is increased in order to express a single dynamic track, motion of a sound source is more finely expressed. In addition, even if a dynamic track is expressed by the same number of control points, a moving speed of the sound source may be expressed by changing the number of frames to which the dynamic track is applied. That is, the less the number of frames, the more the moving speed of the sound source. The more the number of frames, the less the moving speed of the sound source.

In this manner, an amount of data may be reduced by inserting only information used to indicate a dynamic track of a moving sound source into some frames instead of inserting entire position information about the moving source in every frame.

Figure 7:
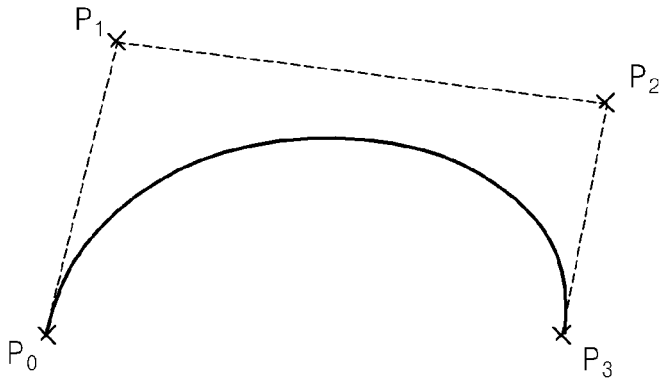
FIG. 7 illustrates a method of expressing a dynamic track of a sound source with a plurality of points, according to an exemplary embodiment.

FIG. 7 illustrates a method of expressing a dynamic track of a sound source with a plurality of points, according to an exemplary embodiment. Referring to FIG. 7, a curve from a point $P_0$ to a point $P_3$ denotes the dynamic track of the sound source, and the points $P_0$ to $P_3$ are used to express the dynamic track.

According to an exemplary embodiment, the dynamic track of the sound source may be expressed by a Bézier curve that is expressed by the points $P_0$ to $P_3$. In this case, the points $P_0$ to $P_3$. are control points of the Bézier curve. The Bézier curve with N+1 control points may be given by Equation 2 below:

$$B(t) = \sum_{i=0}^{n} \binom{n}{i} (1-t)^{n-i} t^i P_i, \quad t \in [0 \quad 1], \tag{2}$$

where $P_i$, that is $P_0$ through $P_n$, are coordinates of control points.

In FIG. 7, since the number of control points is four, the dynamic track of the sound source may be given by Equation 3 below:

$$B(t)=(1-t)^3P_0+3(1-t)^2tP_1+3(1-t)t^2P_2+t^3P_3, t\epsilon[0\ 1] \tag{3}.$$

In this case, all points on the continuous curve from the points from $P_0$ to $P_3$ may be expressed by obtaining coordinates of only four points.

According to an exemplary embodiment, a predetermined position may be found according to the moving properties of a sound source in an audio signal by using information about a dynamic track. For example, a movie may include a static scene such as a conversation between characters, and a dynamic scene such as fight or a car chase. In this case, the movie may be searched for the static scene or the dynamic scene by using information about a dynamic track. In addition, music may be searched for a desired period by using information about motion of singers. According to an exemplary embodiment, when an audio signal is searched according to motion properties, distribution of control points of the dynamic track or the number of frames may be used.

Figure 8:
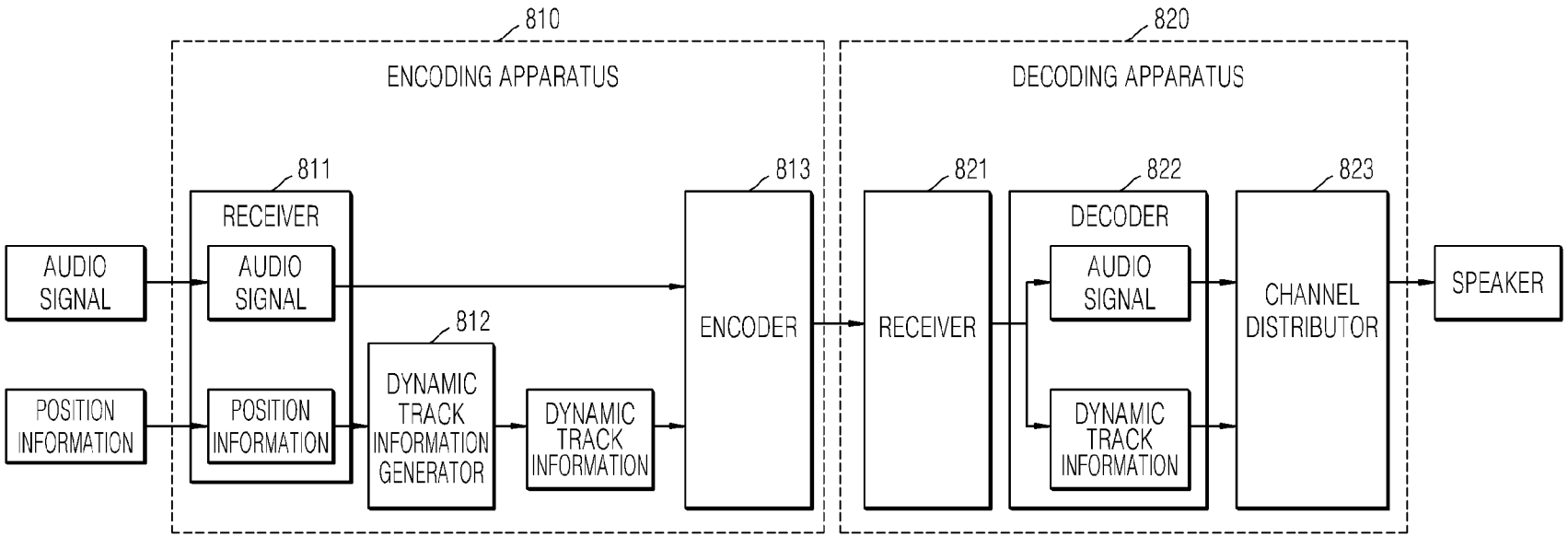
FIG. 8 is a block diagram of an apparatus for encoding an audio signal and an apparatus for decoding an audio signal, using dynamic track information, according to one or more exemplary embodiments.

FIG. 8 is a block diagram of an apparatus 810 for encoding an audio signal and an apparatus 820 for decoding an audio signal, by using dynamic track information, according to one or more exemplary embodiments.

Referring to FIG. 8, the encoding apparatus 810 according to an exemplary embodiment includes a receiver 811, a dynamic track information generator 812, and an encoder 813. The receiver 811 receives an audio signal including information about at least one moving sound source, and position information about each moving source. The dynamic track information generator 812 generates the dynamic track information indicating motion of the sound source by using the position information. The encoder 813 encodes the audio signal and the dynamic track information. The dynamic track information may be encoded in various manners, such as in metadata, as a mode, in header information, etc. Any encoding method that is well known to one of ordinary skill in the art may be used in an exemplary embodiment. However, it is deemed that the detailed description of the encoding method makes unnecessarily obscure the subject matter of the exemplary embodiments, and thus the encoding method will not be described herein for convenience of description of the exemplary embodiments.

The decoding apparatus 820 according to an exemplary embodiment includes a receiver 821, a decoder 822, and a channel distributor 823. The receiver 821 receives a signal encoded by the encoder 813. The decoder 822 decodes the audio signal and the dynamic track information from the received signal. The channel distributor 823 distributes an output, i.e., at least one of an output power and an output signal magnitude, to a plurality of speakers so as to correspond to the dynamic track information so that a listener may listen to an appropriately-positioned sound of a sound source through the speakers.

When the channel distributor 823 recognizes positions of the speakers, the channel distributor 823 controls the output so that a sound image may be formed along a dynamic track by using the dynamic track information of the sound source. Since the speakers are randomly positioned, when the channel distributor 823 does not recognize the positions of the speakers, it is assumed that the speakers are spaced apart from each other by predetermined intervals, and the channel distributor 823 may distribute the output to the speakers so that the sound image may be formed along the dynamic track. Any distributing method that is well known to one of ordinary skill in the art may be used as a method of distributing output to speakers so that a sound image is formed at a predetermined position, according to an exemplary embodiment. However, it is deemed that the detailed description of the distributing method makes unnecessarily obscure the subject matter of the exemplary embodiments, and thus the distributing method will not be described herein for convenience of description of the exemplary embodiments.

As described above, the decoder 822 may change at least one of a frame rate and channel number of an audio signal so as to correctly express audio information by using dynamic track information. In addition, the audio signal may be searched for a period exhibiting predetermined motion properties of a sound source by using the dynamic track information.

Figure 9:
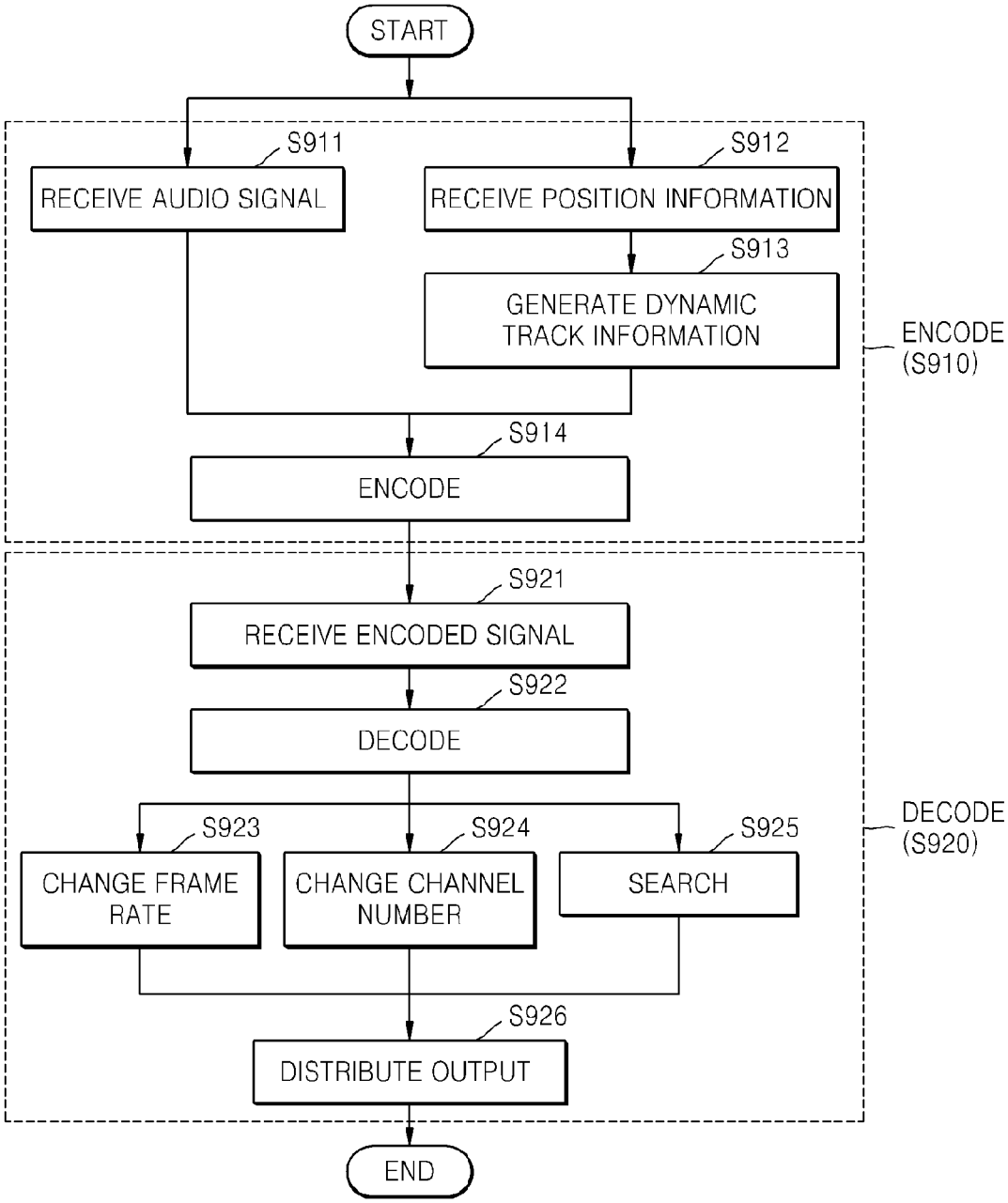
FIG. 9 is a flowchart of methods of encoding and decoding an audio signal by using dynamic track information, according to one or more exemplary embodiments.

FIG. 9 is a flowchart of methods S910 and S920 of encoding and decoding an audio signal by using dynamic track information, according to one or more exemplary embodiments.

Referring to FIG. 9, the method S910 of encoding the audio signal by using the dynamic track information according to an exemplary embodiment includes receiving an audio signal including information about at least one moving sound source (operation S911), receiving position information about each sound source (operation S912), generating the dynamic track information indicating motion of a position of the sound source by using the position information (operation S913), and encoding the audio signal and the dynamic track information (operation S914).

The method S920 of decoding the audio signal by using dynamic track information according to an exemplary embodiment includes receiving the encoded signal (operation S921), decoding the audio signal and the dynamic track information from the received signal (operation S922), changing a frame rate of the audio signal by using the dynamic track information (operation S923), changing the channel number of the audio signal by using the dynamic track information (operation S924), searching the audio signal for a period exhibiting predetermined motion properties of the sound source by using the dynamic track information (operation S925), and distributing output to a plurality of speakers so as to correspond to the dynamic track information (operation S926). The above-described operations may not be sequentially performed, and may be performed in parallel or selectively.

Encoding and Decoding Audio Signal by Using Semantic Object

A method of encoding an audio signal by using a semantic object according to an exemplary embodiment includes dividing audio objects of the audio signal into minimum objects, and encoding parameters indicating the divided minimum objects.

Figure 10:
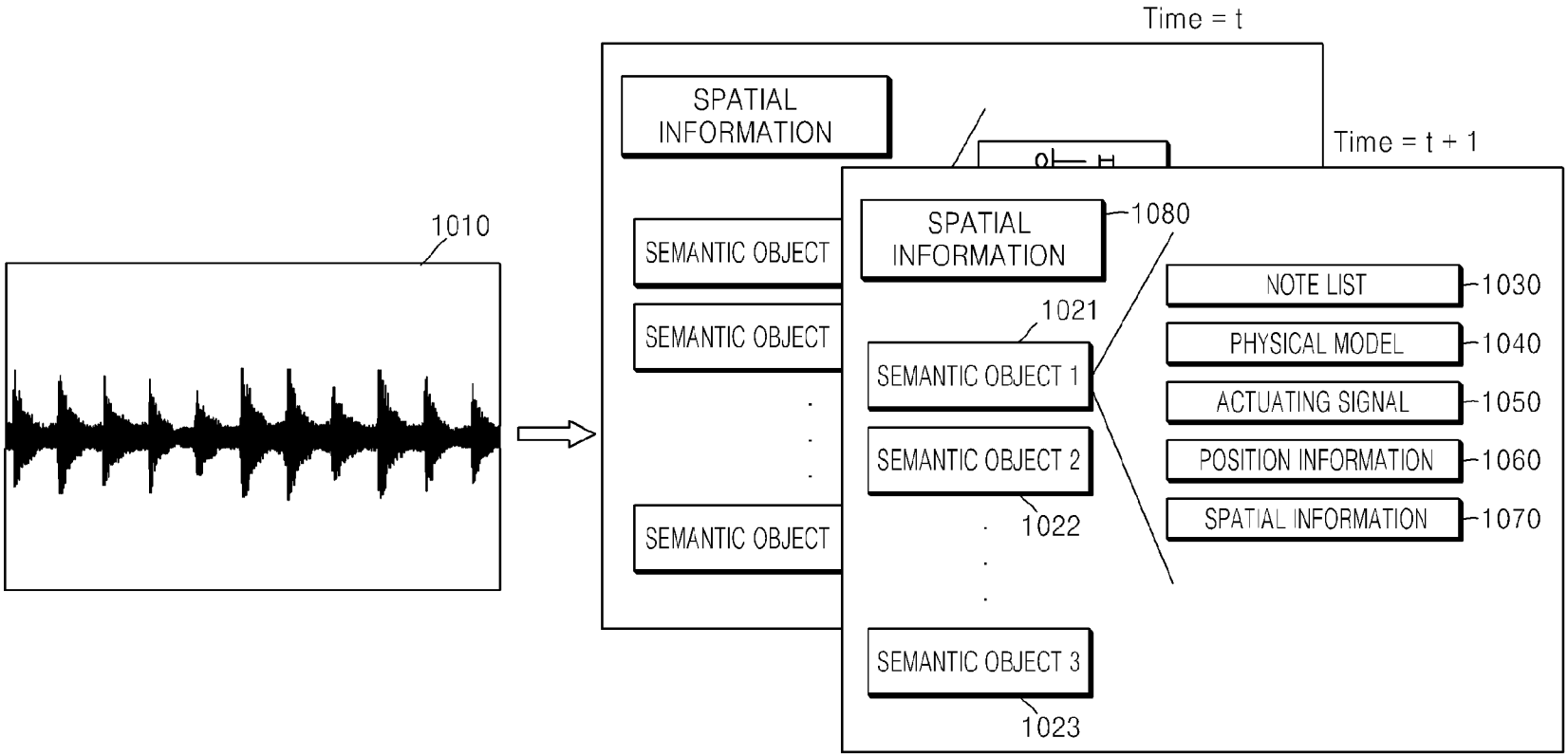
FIG. 10 illustrates a method of encoding an audio signal by using a semantic object, according to an exemplary embodiment.

FIG. 10 illustrates a method of encoding an audio signal by using a semantic object, according to an exemplary embodiment.

Referring to FIG. 10, the method of encoding the audio signal by using the semantic object includes dividing a sound source for generating an audio signal 1010 into recognizable semantic objects 1021 through 1023, defining a physical model 1040 for each of the recognizable semantic objects 1021 through 1023, and encoding and compressing an actuating signal 1050 of the physical model 1040 and a note list 1030. In addition, position information 1060 and spatial information 1070 of the semantic objects 1021 through 1023 and spatial information 1080 of the audio signal 1010 may be encoded together. Parameter information may be encoded every frame, or every time interval, and may be encoded whenever a parameter is changed, though it is understood that another exemplary embodiment is not limited thereto. For example, according to another exemplary embodiment, the parameter information may be encoded all the time, or only a parameter that is changed in a previous parameter may be encoded.

Figure 11A:
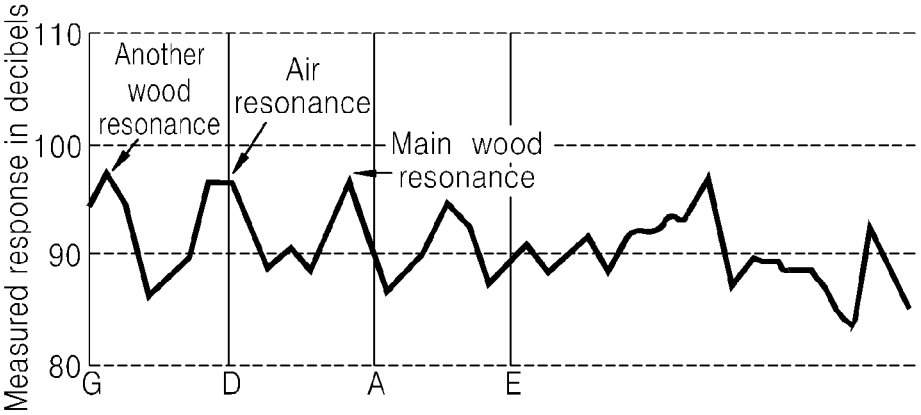
FIGS. 11A through 11C illustrate examples of a semantic object, according to one or more exemplary embodiments.
Figure 11B:
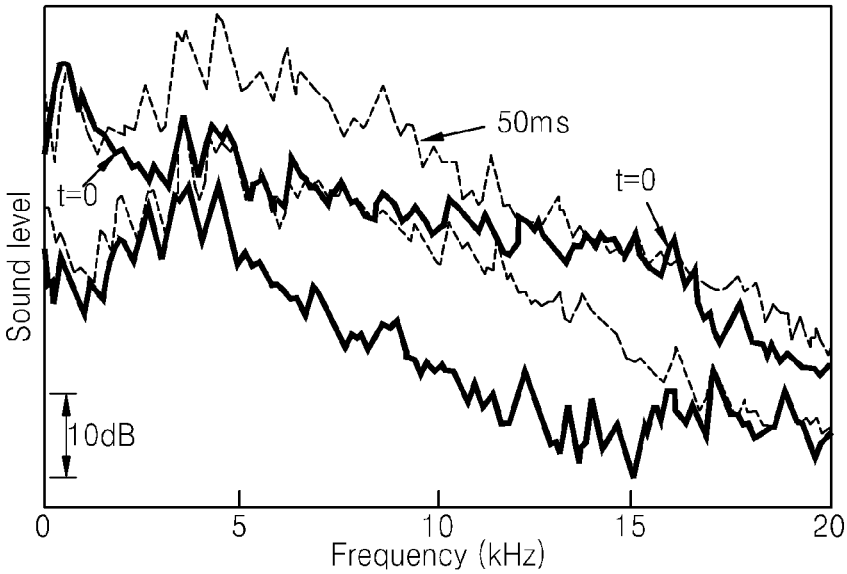
Figure 11C:
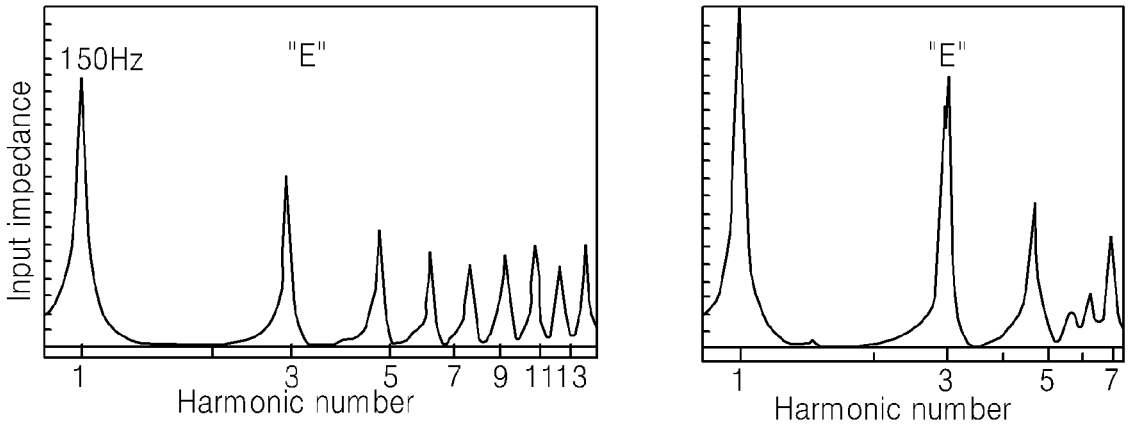

The physical model 1040 for each of the semantic objects 1021 through 1023 is a model for indicating the physical properties of each of the semantic objects 1021 through 1023, and may be efficiently used to express repeated creation/ extinction of the sound source. Examples of the physical model 1040 are illustrated in FIGS. 11A through 11C. FIG. 11A is an example of a physical model of a violin that is a string instrument, and FIG. 11B is an example of a physical model of a clarinet that is a wind instrument.

According to an exemplary embodiment, the physical model 1040 for each of the semantic objects 1021 through 1023 is modeled into a transfer function coefficient, e.g., Fourier synthesis coefficient, or the like. For example, when an actuating signal applied to a semantic object is x(t) and an audio signal generated in the semantic object is y(t), a physical model H(s) may be given by Equation 4 below:

$$H(s) = \frac{Y(s)}{X(s)} = \frac{\mathcal{L}\{y(t)\}}{\mathcal{L}\{x(t)\}}. \quad (4)$$

Thus, a transfer function coefficient that is a physical model of an instrument may be obtained by using an actuating signal applied to an instrument and a sound generated by the instrument, though it is understood that another exemplary embodiment is not limited thereto. For example, in another exemplary embodiment, a transfer function coefficient that is frequently used may be previously stored in a decoding device, and a difference value between the previously stored transfer function coefficient and a transfer function coefficient of a semantic object may be encoded in an encoding process.

In addition, a plurality of physical models may be defined for a single instrument, and a single physical model may be selected according to a pitch, or the like, from among the physical models.

FIGS. 12A through 12D illustrate examples of an actuating signal 1050 of a semantic object according to one or more exemplary embodiments. In particular, FIGS. 12A through 12D illustrate actuating signals of a woodwind instrument, a string instrument, a brass instrument, and a keyboard instrument, respectively.

Figure 12A:
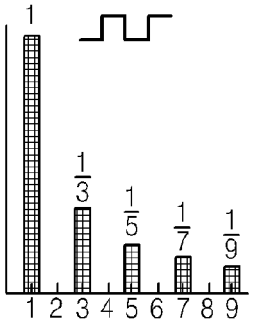
FIGS. 12A through 12D illustrate examples of an actuating signal of a semantic object, according to one or more exemplary embodiments.
Figure 12B:
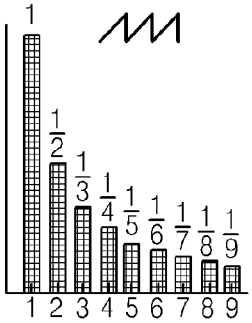
Figure 12C:
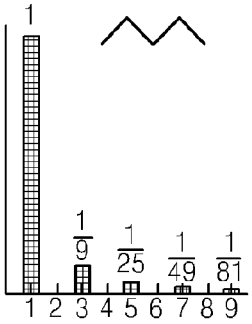
Figure 12D:
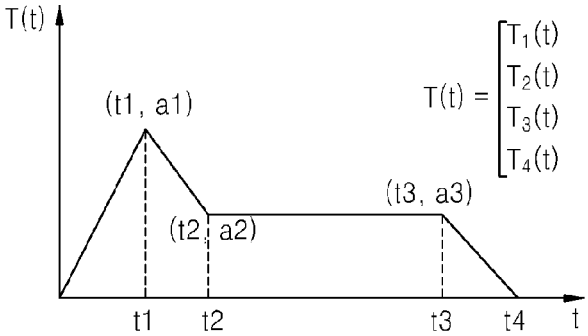

The actuating signal 1050 is a signal that is applied by an external source so as to generate a sound in the semantic object. For example, an actuating signal of a piano is a signal applied when a keyboard of the piano is pushed, and an actuating signal of a violin is a signal applied when a violin is bowed. Theses actuating signals may be indicated according to a period of time, as illustrated in FIG. 12D, and may reflect main musical signs, a performance style of a musician, etc. In a time domain, the musical sign may indicate the size and speed of an actuating signal, and the performance style may be indicated by a slope of the actuating signal.

The actuating signal 1050 may reflect the properties of instruments as well as the performance style. For example, when a violin is bowed, a string is pulled to one side due to a friction between the string and the bow. Then, the string is restored to an original position when reaching a predetermined threshold point. These processes are repeated. Thus, the actuating signal of the violin exhibits a shape of saw tooth wave of FIG. 12B.

According to an exemplary embodiment, the actuating signal 1050 may be encoded by transforming the actuating signal 1050 in a frequency domain and then expressing the actuating signal 1050 in a predetermined function. When the actuating signal 1050 may be expressed in a function form having periodicity, as illustrated in FIGS. 12A through 12C, Fourier synthesis coefficient may be encoded. According to another exemplary embodiment, coordinates of main points exhibiting the properties of wave form may be encoded in a time domain (e.g., a vocal cord/tract model of voice code). For example, T(t) may be expressed by encoding coordinates (t1,a1), (t2,a2), (t3,a3), and (t4,0) in FIG. 12D. This method is especially useful when it is impossible to encode the actuating signal 1050 into a simple coefficient.

The note list 1030 includes information about pitch and beat. According to an exemplary embodiment, the actuating signal 1050 may be changed by using the pitch and the beat of the note list 1030. For example, a value obtained by multiplying the actuating signal 1050 by a sine wave corresponding to the pitch of the note list 1030 is used as input of the physical model 1040.

According to another exemplary embodiment, the physical model 1040 may be changed by using the pitch of the note list 1030, or a single physical model may be selected and used according to the pitch of the note list 1030 from among a plurality of physical models, as described above.

The parameter of each of the semantic objects 1021 through 1023 may include the position information 1060 of each of the semantic objects 1021 through 1023. The position information 1060 may indicate a position where each semantic object exists. The semantic objects 1021 through 1023 may be appropriately positioned based on the position information 1060. The position information 1060 may be used to encode an absolute coordinate thereof, or may reduce an amount of data by encoding a motion vector for indicating a change in an absolute coordinate. In addition, the position information 1060 may be used to encode dynamic track information.

The parameter of each of the semantic objects 1021 through 1023 may include the spatial information 1070 of the semantic objects 1021 through 1023. The spatial information 1070 indicates a reverberation property of a space where each of the semantic objects 1021 through 1023 exists. Thus, a listener may have a sense of realism of an actual place. Alternatively, entire spatial information 1080 of the audio signal 1010 may be encoded instead of spatial information of each semantic object.

According to an exemplary embodiment, when a method of encoding an audio signal by using a semantic object is used, the audio signal may be searched and edited by using the semantic object. For example, a predetermined semantic object or a predetermined parameter is searched for, is divided, or is edited, and thus a predetermined instrument sound may be searched for, may be deleted, may be replaced with another instrument sound, may be changed according to another player's performance style, or may be moved to another place, in an audio signal including information about an orchestra's performance.

Figure 13:
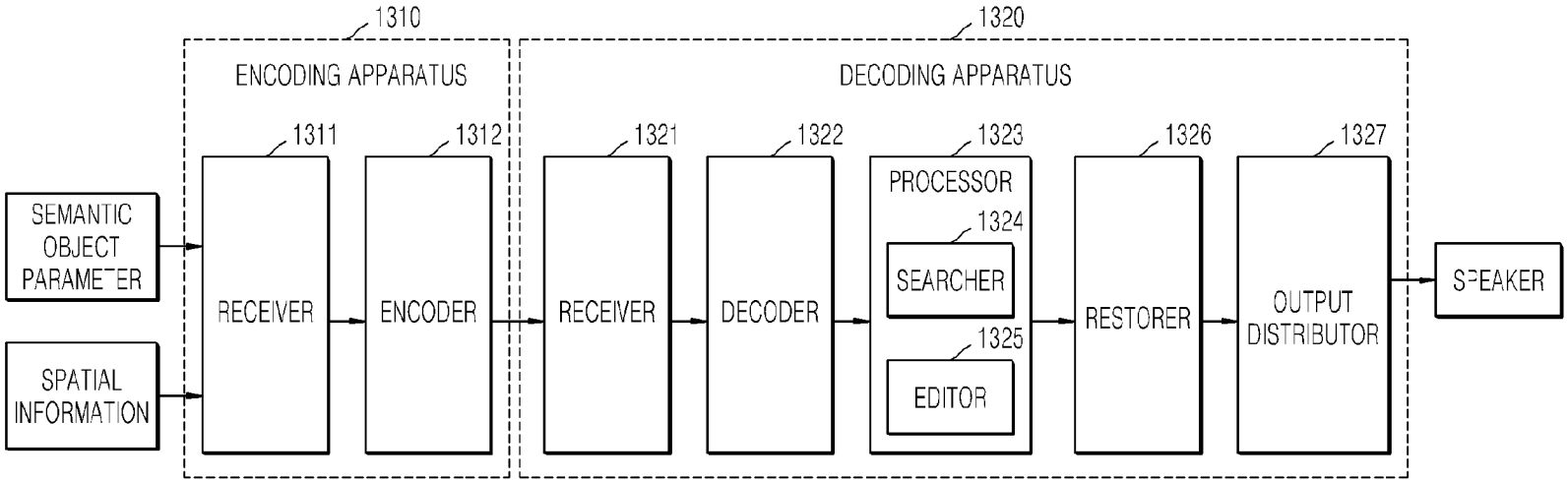
FIG. 13 is a block diagram of an apparatus for encoding an audio signal and an apparatus for decoding an audio signal, by using a semantic object, according to one or more exemplary embodiments.

FIG. 13 is a block diagram of an apparatus 1310 for encoding an audio signal and an apparatus 1320 for decoding an audio signal, by using a semantic object, according to one or more exemplary embodiments.

Referring to FIG. 13, the encoding apparatus 1310 according to an exemplary embodiment includes a receiver 1311 and an encoder 1312. The receiver 1311 receives parameters indicating the properties of semantic objects of the audio signal, and spatial information 1080 of a space where the audio signal is generated. The encoder 1312 encodes the parameters and the spatial information 1080. Any encoding method that is well known to one of ordinary skill in the art may be used in an exemplary embodiment. However, it is deemed that the detailed description of the encoding method makes unnecessarily obscure the subject matter of the exemplary embodiments, and thus the encoding method will not be described herein for convenience of description of the exemplary embodiments.

The decoding apparatus 1320 according to an exemplary embodiment includes a receiver 1321, a decoder 1322, a processor 1323, a restorer 1326, and an output distributor 1327. The receiver 1321 receives a signal encoded by the encoder 1312. The decoder 1322 decodes the received signal, and extracts parameters of each semantic object and the spatial information 1080 of the audio signal. The processor 1323 includes a searcher 1324 and an editor 1325. The searcher 1234 searches for at least one of a predetermined semantic object, a predetermined parameter, and predetermined spatial information. The editor 1325 performs editing such as separation, deletion, addition, or replacement on at least one of the predetermined semantic object, the predetermined parameter, and the spatial information. The restorer 1326 may restore the audio signal by using the restored parameter and the spatial information 1080, or may generate the edited audio signal by using the edited parameter and the spatial information 1080. The output distributor 1327 distributes output to a plurality of speakers by using the decoded position information or the edited position information.

Figure 14:
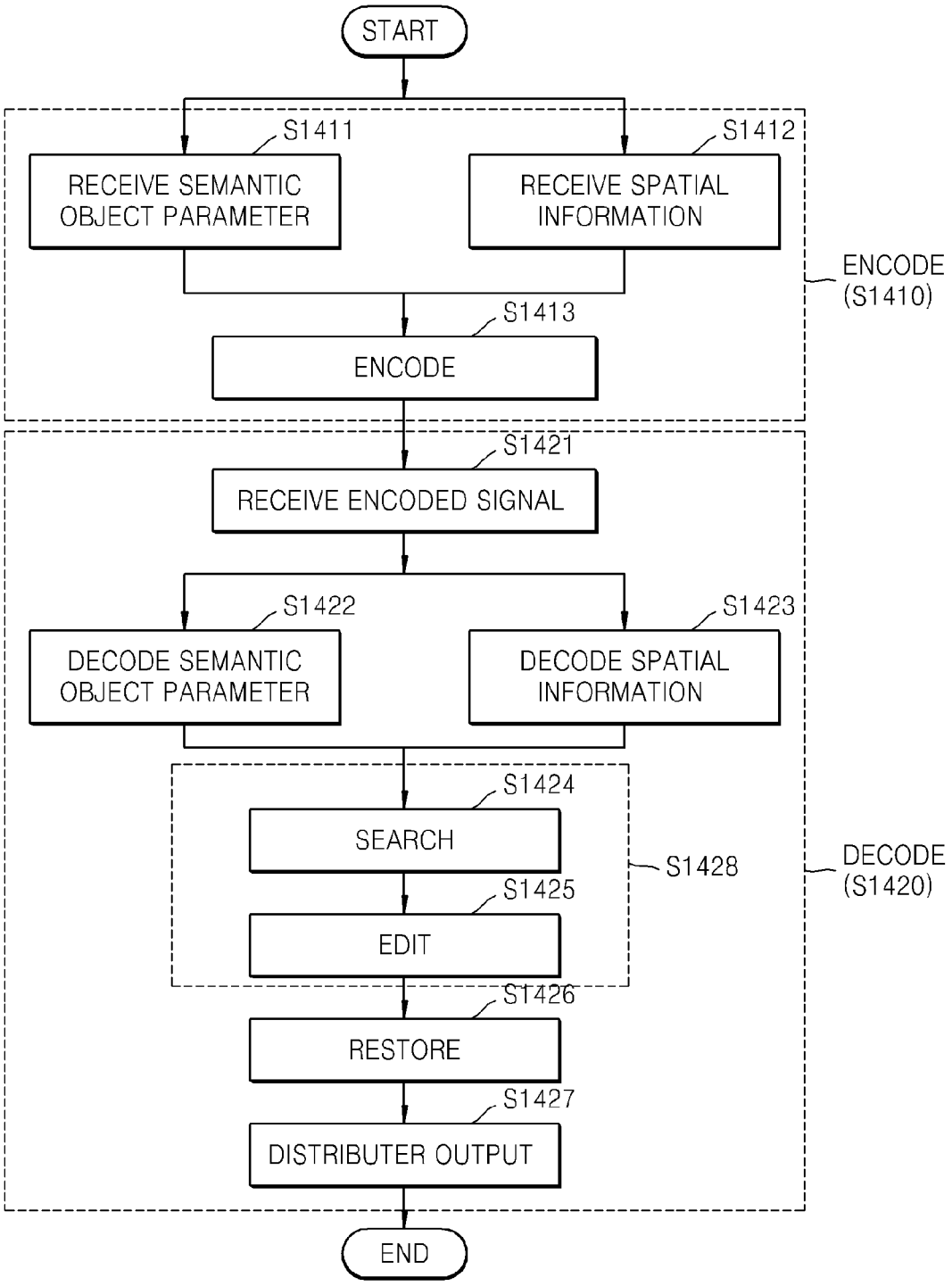
FIG. 14 is a flowchart of methods of encoding and decoding an audio signal by using a semantic object, according to one or more exemplary embodiments.

FIG. 14 is a flowchart of methods S1410 and S1420 of encoding and decoding an audio signal by using a semantic object, according to one or more exemplary embodiments.

Referring to FIG. 14, the method S1410 of encoding an audio signal by using a semantic object according to an exemplary embodiment includes receiving parameters indicating properties of semantic objects of the audio signal (operation S1411), receiving spatial information of a space where the audio signal is generated (operation S1412), and encoding the parameters and the spatial information (operation S1413).

The method (S1420) of decoding an audio signal by using a semantic object according to an exemplary embodiment includes receiving the encoded signal (operation S1421), decoding parameters of each semantic object from the received signal (operation S1422), decoding spatial information of the audio signal from the received signal (operation S1423), processing the parameters and the spatial information of the audio signal (operation S1428), restoring the audio signal by using the parameters and the spatial information of the audio signal (operation S1426), and distributing output to a plurality of speakers by using position information (operation S1427). The processing (operation S1428) includes searching for a predetermined semantic object, a predetermined parameter, or predetermined spatial information (operation S1424), and performing editing such as separation, deletion, addition, or replacement on the predetermined semantic object, the predetermined parameter, or the spatial information (operation S1425). The above-described operations may not be sequentially performed, and may be performed in parallel or selectively.

While not restricted thereto, an exemplary embodiment can be embodied as computer readable codes on a computer readable recording medium. The computer readable recording medium is any data storage device that can store data which can be thereafter read by a computer system.

Examples of the computer readable recording medium include read-only memory (ROM), random-access memory (RAM), CD-ROMs, magnetic tapes, floppy disks, optical data storage devices, etc. The computer readable recording medium can also be distributed over network coupled computer systems so that the computer readable code is stored and executed in a distributed fashion. Also, functional programs, codes, and code segments for accomplishing an exemplary embodiment can be easily construed by programmers skilled in the art to which the exemplary embodiment pertains.

While exemplary embodiments have been particularly shown and described with reference to the drawings, it will be understood by those skilled in the art that various changes in form and details may be made therein without departing from the spirit and scope of the inventive concept as defined by the appended claims. The exemplary embodiments should be considered in descriptive sense only and not for purposes of limitation. Therefore, the scope of the inventive concept is defined not by the detailed description of the exemplary embodiments but by the appended claims, and all differences within the scope will be construed as being included in the present inventive concept.

The invention claimed is:

1. A method of encoding an audio signal, the method comprising:

receiving an audio signal comprising information about a moving sound source;

receiving position information about the moving sound source;

generating dynamic track information indicating motion of the moving sound source by using the position information; and encoding the audio signal and the dynamic track information, wherein the dynamic track information comprises control points which express a dynamic track of the moving sound source and the number of frames to which the dynamic track expressed by the control points is applied.

2. The method of claim 1, wherein the dynamic track information comprises a plurality of points for expressing the dynamic track.

3. The method of claim 2, wherein the dynamic track is a Bézier curve using the plurality of points as control points.

4. The method of claim 2, wherein:

when the dynamic track is applied to a first frame and a second frame, the encoding the audio signal and the dynamic track information comprises inserting the dynamic track information into the first frame and not the second frame.

5. A method of decoding an audio signal, the method comprising:

receiving a signal comprising an encoded audio signal and encoded dynamic track information, the audio signal comprising information about a moving sound source and the dynamic track information indicating motion of a position of the moving sound source; and decoding the encoded audio signal and the encoded dynamic track information from the received signal, wherein the dynamic track information comprises control points which express a dynamic track of the moving sound source and the number of frames to which the dynamic track expressed by the control points is applied.

6. The method of claim 5, further comprising distributing output to a plurality of speakers so as to correspond to the dynamic track information.

7. The method of claim 5, further comprising changing a frame rate of the audio signal by using the dynamic track information.

8. The method of claim 5, further comprising changing a number of channels of the audio signal by using the dynamic track information.

9. The method of claim 5, further comprising searching the audio signal for a period corresponding to a predetermined motion property of the moving sound source by using the dynamic track information.

10. The method of claim 9, wherein:

the dynamic track information comprises a plurality of points for expressing the dynamic track; and the searching is performed by using the plurality of points.

11. The method of claim 10, wherein:

the searching is performed by using the number of the frames comprised in the dynamic track information.

12. The method of claim 5, wherein:

the dynamic track information comprises a plurality of points for expressing the dynamic track; and when the dynamic track is applied to a first frame and a second frame, the dynamic track information is comprised in the first frame and not the second frame.

13. A method of encoding an audio signal, the method comprising:

receiving a reverberation property of an audio signal separately from receiving the audio signal, the reverberation property being initially separately recorded from the audio signal;

obtaining the audio signal based on the reverberation property; and encoding, by an encoder comprising a processor, the obtained audio signal and the reverberation property.

14. The method of claim 13, wherein:

the audio signal is recorded in a predetermined space; and the reverberation property is of the predetermined space.

15. The method of claim 13, wherein the reverberation property is indicated by an impulse response.

16. The method of claim 15, wherein the encoding comprises encoding the audio signal so that an initial reverberation period of the impulse response is expressed in a type of a high-degree infinite impulse response (IIR) filter, and a latter reverberation period of the impulse response is expressed in a type of a low-degree infinite impulse response filter.

17. A method of decoding an audio signal, the method comprising:

receiving a signal comprising an encoded first reverberation property and an encoded audio signal comprising the first reverberation property, the encoded first reverberation property being initially separately recorded from the encoded audio signal;

decoding, by a decoder comprising a processor, the encoded audio signal from the received signal; and generating the decoded audio signal based on the encoded audio signal and the first reverberation property.

18. The method of claim 17, further comprising:

decoding the first reverberation property from the received signal;

calculating a reversed function of the first reverberation property; and obtaining an audio signal from which the first reverberation property is removed by applying the reversed function to the audio signal comprising the first reverberation property.

19. The method of claim 18, further comprising:

receiving a second reverberation property; and generating an audio signal comprising the second reverberation property by applying the second reverberation property to the audio signal from which the first reverberation property is removed.

20. The method of claim 19, wherein the receiving the second reverberation property comprises receiving the second reverberation property input by a user from an input device, or receiving the second reverberation property that is previously stored in a memory, from the memory.

21. The method of claim 17, wherein:

the audio signal is recorded in a predetermined space; and the first reverberation property is of the predetermined space.

22. A method of encoding an audio signal, the method comprising:

receiving an audio signal recorded in a predetermined space;

receiving a reverberation property of the predetermined space, the reverberation property being initially separately recorded from the audio signal;

calculating a reversed function of the reverberation property;

obtaining an audio signal from which the reverberation property is removed by applying the reversed function to the received audio signal; and encoding the reverberation property and the audio signal from which the reverberation property is removed.

23. A method of decoding an audio signal, the method comprising:

receiving a signal comprising an encoded audio signal and an encoded reverberation property, the encoded audio signal being initially separately recorded from the encoded reverberation property;

decoding the encoded audio signal from the received signal;

decoding the encoded reverberation property from the received signal; and obtaining an audio signal comprising the reverberation property by applying the decoded reverberation property to the decoded audio signal.

24. A method of decoding an audio signal, the method comprising:

receiving a signal comprising an encoded audio signal and an encoded first reverberation property, the encoded audio signal being initially separately recorded from the encoded first reverberation property;

decoding the encoded audio signal from the received signal;

receiving a second reverberation property;

generating an audio signal comprising the second reverberation property by applying the received second reverberation property to the decoded audio signal, and generating another audio signal comprising the first reverberation property by applying the received first reverberation property to the decoded audio signal.

25. A method of encoding an audio signal, the method comprising:

receiving, for each of a plurality of semantic objects of the audio signal, at least one parameter indicating at least one property of the semantic object of the audio signal; and encoding, for each of the plurality of the semantic objects of the audio signal, by an encoder comprising a processor, the at least one parameter, wherein, for each of the plurality of the semantic objects of the audio signal, the at least one parameter comprises a physical model comprising a transfer function to express a repeated creation and/or extinction of a sound source and indicates a physical property of thea sound source corresponding to the semantic object.

26. The method of claim 25, wherein the at least one parameter further comprises at least one of:

a note list which indicates pitch and beat of the semantic object; and an actuating signal which actuates the semantic object.

27. The method of claim 26, wherein the transfer function is a ratio between an output signal and the actuating signal in a frequency domain.

28. The method of claim 26, wherein the encoding comprises encoding a coefficient in a frequency domain of the actuating signal.

29. The method of claim 26, wherein the encoding comprises encoding coordinates of a plurality of points in a time domain of the actuating signal.

30. The method of claim 25, wherein the at least one parameter comprises position information indicating a position of the semantic object.

31. The method of claim 25, wherein the at least one parameter comprises spatial information indicating a reverberation property of a space where the audio signal of the semantic object is generated.

32. The method of claim 25, further comprising:

receiving spatial information indicating a reverberation property of a space where the audio signal is generated, wherein the encoding comprises encoding the at least one parameter comprising the spatial information.

33. The method of claim 31, wherein the spatial information comprises an impulse response exhibiting the reverberation property.

34. A method of decoding an audio signal, the method comprising:

receiving, for each of a plurality of semantic objects of the audio signal, an input signal comprising at least one encoded parameter indicating at least one property of the semantic object of the audio signal; and decoding, for each of the plurality of the semantic objects of the audio signal, by a decoder comprising a processor, the at least one encoded parameter from the input signal, wherein, for each of the plurality of the semantic objects of the audio signal, the at least one encoded parameter comprises a physical model comprising a transfer function to express a repeated creation and/or extinction of a sound source and indicates a physical property of the sound source corresponding to the semantic object.

35. The method of claim 34, further comprising restoring the audio signal by using the at least one parameter.

36. The method of claim 34, wherein the at least one parameter further comprises at least one of:

a note list which indicates pitch and beat of the semantic object; and an actuating signal which actuates the semantic object.

37. The method of claim 34, wherein the at least one parameter further comprises position information indicating a position of the semantic object.

38. The method of claim 37, further comprising distributing output to a plurality of speakers so as to correspond to the position information.

39. The method of claim 34, wherein the at least one parameter comprises spatial information indicating a reverberation property of a space where the audio signal of the semantic object is generated.

40. The method of claim 34, further comprising decoding spatial information from the input signal, wherein the input signal further comprises the spatial information indicating a reverberation property of a space where the audio signal is generated.

41. The method of claim 40, further comprising restoring the audio signal by using the at least one parameter and the spatial information.

42. The method of claim 34, further comprising processing the at least one parameter.

43. The method of claim 42, wherein the processing comprises searching for a parameter corresponding to a predetermined audio property from among the at least one parameter.

44. The method of claim 42, wherein the processing comprises editing a parameter of the at least one parameter.

45. The method of claim 44, further comprising generating an edited audio signal by using the edited parameter.

46. The method of claim 44, wherein the editing the parameter comprises at least one of deleting the semantic object from the audio signal, inserting a new semantic object into the audio signal, and replacing the semantic object of the audio signal with the new semantic object.

47. The method of claim 44, wherein the editing the parameter comprises at least one of deleting the parameter, inserting a previously presented parameter into the audio signal, and replacing the parameter with the new parameter.

48. An apparatus for encoding an audio signal, the apparatus comprising:

a processor;

a receiver which receives an audio signal comprising information about a moving sound source and position information about the moving sound source;

a dynamic track information generator which generates dynamic track information indicating motion of the moving sound source by using the position information; and an encoder which uses the processor which encodes the audio signal and the dynamic track information, wherein the dynamic track information comprises control points which express a dynamic track of the moving sound source and the number of frames to which the dynamic track expressed by the control points is applied.

49. The apparatus of claim 48, wherein the dynamic track information comprises a plurality of points for expressing the dynamic track.

50. The apparatus of claim 49, wherein the dynamic track is a Bézier curve using the plurality of points as control points.

51. An apparatus for decoding an audio signal, the apparatus comprising:

a processor;

a receiver which receives a signal comprising an encoded audio signal and encoded dynamic track information, the audio signal comprising information about a moving sound source and the dynamic track information indicating motion of a position of the moving sound source; and a decoder which uses the processor which decodes the audio signal and the dynamic track information from the received signal, wherein the dynamic track information comprises control points which express a dynamic track of the moving sound source and the number of frames to which the dynamic track expressed by the control points is applied.

52. The apparatus of claim 51, further comprising an output distributor which distributes output to a plurality of speakers so as to correspond to the dynamic track information.

53. The apparatus of claim 51, wherein the decoder changes a frame rate of the audio signal by using the dynamic track information.

54. The apparatus of claim 51, wherein the decoder changes a number of channels of the audio signal by using the dynamic track information.

55. The apparatus of claim 51, wherein the decoder searches the audio signal for a period corresponding to a predetermined motion property of the moving sound source by using the dynamic track information.

56. The apparatus of claim 55, wherein:

the dynamic track information comprises a plurality of points for expressing the dynamic track; and the decoder searches the audio signal by using the plurality of points.

57. The apparatus of claim 56, wherein:

the decoder searches the audio signal by using the number of the frames comprised in the dynamic track information.

58. An apparatus for encoding an audio signal, the apparatus comprising:

a processor;

a receiver which separately receives an audio signal and a reverberation property of the audio signal, the reverberation property being initially separately recorded from the audio signal;

an obtainer which obtains the audio signal based on the reverberation property; and an encoder which uses the processor which encodes the obtained audio signal and the reverberation property.

59. The apparatus of claim 58, wherein:

the audio signal is recorded in a predetermined space; and the reverberation property is of the predetermined space.

60. The apparatus of claim 58, wherein the reverberation property is indicated by an impulse response.

61. The apparatus of claim 60, wherein the encoder encodes the audio signal so that an initial reverberation period of the impulse response is expressed in a type of a high-degree infinite impulse response (IIR) filter, and a latter reverberation period of the impulse response is expressed in a type of a low-degree infinite impulse response filter.

62. An apparatus for decoding an audio signal, the apparatus comprising:

a processor;

a receiver which receives a signal comprising an encoded first reverberation property and an encoded audio signal comprising the first reverberation property, the encoded first reverberation property being initially separately recorded from the encoded audio signal;

a decoder which uses the processor which decodes the audio signal from the received signal; and a generator which generates the decoded audio signal based on the encoded audio signal and the first reverberation property.

63. The apparatus of claim 62, further comprising a reverberation remover which decodes the first reverberation property from the received signal, calculates a reversed function of the first reverberation property, and obtains an audio signal from which the first reverberation property is removed by applying the reversed function to the audio signal comprising the first reverberation property.

64. The apparatus of claim 63, further comprising a reverberation applier which receives a second reverberation property, and generates an audio signal comprising the second reverberation property by applying the received second reverberation property to the audio signal from which the first reverberation property is removed.

65. The apparatus of claim 64, wherein the receiver receives the second reverberation property input by a user from an input device, or receives the second reverberation property that is previously stored in a memory, from the memory.

66. The apparatus of claim 62, wherein:

the audio signal is recorded in a predetermined space; and the first reverberation property is of the predetermined space.

67. An apparatus for encoding an audio signal, the apparatus comprising:

a processor;

a receiver which receives an audio signal recorded in a predetermined space, and a reverberation property of the predetermined space, the reverberation property being initially separately recorded from the audio signal;

a reverberation remover which calculates a reversed function of the reverberation property, and obtains an audio signal from which the reverberation property is removed by applying the reversed function to the received audio signal; and an encoder which uses the processor which encodes the reverberation property and the audio signal from which the reverberation property is removed.

68. An apparatus for decoding an audio signal, the apparatus comprising:

a processor;

a receiver which receives a signal comprising an encoded audio signal and an encoded reverberation property, the encoded audio signal being initially separately recorded from the encoded audio signal;

a decoder which uses the processor which decodes the audio signal and the reverberation property from the received signal; and a reverberation restorer which obtains an audio signal comprising the reverberation property by applying the decoded reverberation property to the decoded audio signal.

69. An apparatus for decoding an audio signal, the apparatus comprising:

a processor;

a receiver which receives a second reverberation property and a signal comprising an encoded audio signal and an encoded first reverberation property, the encoded audio signal being initially separately recorded from the encoded first reverberation property;

a decoder which uses the processor which decodes the audio signal from the received signal; and a reverberation applier which generates an audio signal comprising the second reverberation property by applying the second reverberation property to the audio signal and generates another audio signal comprising the first reverberation property by applying the first reverberation property to the audio signal.

70. An apparatus for encoding an audio signal, the apparatus comprising:

a processor;

a receiver which, for each of a plurality of semantic objects of an audio signal, receives at least one parameter indicating at least one property of a semantic object of the audio signal; and an encoder which uses the processor which, for each of the plurality of semantic objects of the audio signal, encodes the at least one parameter, wherein, for each of the plurality of semantic objects of the audio signal, the at least one parameter comprises a physical model comprising a transfer function to express a repeated creation and/or extinction of a sound source and indicates a physical property of the sound source corresponding to the semantic object.

71. The apparatus of claim 70, wherein the at least one parameter further comprises at least one of:

a note list which indicates pitch and beat of the semantic object; and an actuating signal which actuates the semantic object.

72. The apparatus of claim 71, wherein the transfer function is a ratio between an output signal and the actuating signal in a frequency domain, with regard to the semantic object.

73. The apparatus of claim 71, wherein the encoder encodes a coefficient in a frequency domain of the actuating signal.

74. The apparatus of claim 71, wherein the encoder encodes coordinates of a plurality of points in a time domain of the actuating signal.

75. The apparatus of claim 70, wherein the at least one parameter comprises position information indicating a position of the semantic object.

76. The apparatus of claim 70, wherein the at least one parameter comprises spatial information indicating a reverberation property of a space where the audio signal of the semantic object is generated.

77. The apparatus of claim 70, wherein:

the receiver receives spatial information indicating a reverberation property of a space where the audio signal is generated; and the encoder encodes the at least one parameter comprising the spatial information.

78. The apparatus of claim 76, wherein the spatial information comprises an impulse response exhibiting the reverberation property.

79. An apparatus for decoding an audio signal, the apparatus comprising:

a processor;

a receiver which, for each of a plurality of semantic objects of the audio signal, receives an input signal comprising at least one encoded parameter indicating at least one property of the semantic object of the audio signal; and a decoder which uses the processor which, for each of the plurality of the semantic objects of the audio signal, decodes the at least one encoded parameter from the input signal, wherein, for each of the plurality of the semantic objects of the audio signal, the at least one encoded parameter comprises a physical model comprising a transfer function to express a repeated creation and/or extinction of a sound source and which indicates a physical property of the sound source corresponding to the semantic object.

80. The apparatus of claim 79, further comprising a restorer which restores the audio signal by using the at least one parameter.

81. The apparatus of claim 79, wherein the at least one parameter further comprises at least one of:

a note list which indicates pitch and beat of the semantic object; and an actuating signal which actuates the semantic object.

82. The apparatus of claim 79, wherein the at least one parameter further comprises position information indicating a position of the semantic object.

83. The apparatus of claim 82, further comprising an output distributor which distributes output to a plurality of speakers so as to correspond to the dynamic track information.

84. The apparatus of claim 79, wherein the at least one parameter further comprises spatial information indicating a reverberation property of a space where the audio signal of the semantic object is generated.

85. The apparatus of claim 79, wherein:

the input signal further comprises encoded spatial information indicating a reverberation property of a space where the audio signal is generated; and the decoder decodes the spatial information from the input signal.

86. The apparatus of claim 85, further comprising a restorer which restores the audio signal by using the at least one parameter and the spatial information.

87. The apparatus of claim 79, further comprising a processor which processes the at least one parameter.

88. The apparatus of claim 87, wherein the processor comprises a searcher which searches for a parameter corresponding to a predetermined audio property from among the at least one parameter.

89. The apparatus of claim 87, wherein the processor comprises an editor which edits the at least one parameter.

90. The apparatus of claim 89, further comprising a generator which generates an edited audio signal by using the edited parameter.

91. The apparatus of claim 89, wherein the editor deletes the semantic object from the audio signal, inserts a new semantic object into the audio signal, or replaces the semantic object of the audio signal with the new semantic object.

92. The apparatus of claim 89, wherein the editor deletes the at least one parameter, inserts a new parameter into the audio signal, or replaces the at least one parameter with the new parameter.

93. A non-transitory computer readable recording medium having recorded thereon a program executed by a computer for performing the method of claim 1.

94. A non-transitory computer readable recording medium having recorded thereon a program executed by a computer for performing the method of claim 5.

95. A non-transitory computer readable recording medium having recorded thereon a program executed by a computer for performing the method of claim 13.

96. A non-transitory computer readable recording medium having recorded thereon a program executed by a computer for performing the method of claim 17.

97. A non-transitory computer readable recording medium having recorded thereon a program executed by a computer for performing the method of claim 22.

98. A non-transitory computer readable recording medium having recorded thereon a program executed by a computer for performing the method of claim 23.

99. A non-transitory computer readable recording medium having recorded thereon a program executed by a computer for performing the method of claim 24.

100. A non-transitory computer readable recording medium having recorded thereon a program executed by a computer for performing the method of claim 25.

101. A non-transitory computer readable recording medium having recorded thereon a program executed by a computer for performing the method of claim 34.

* * * * *